US009804515B2

(12) United States Patent
Sugiura et al.

(10) Patent No.: US 9,804,515 B2
(45) Date of Patent: Oct. 31, 2017

(54) TONER, IMAGE FORMING APPARATUS, IMAGE FORMING METHOD, PROCESS CARTRIDGE, AND DEVELOPER

(71) Applicants: Hideki Sugiura, Shizuoka (JP); Shinya Nakayama, Shizuoka (JP); Toyoshi Sawada, Kanagawa (JP)

(72) Inventors: Hideki Sugiura, Shizuoka (JP); Shinya Nakayama, Shizuoka (JP); Toyoshi Sawada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 211 days.

(21) Appl. No.: 14/422,270

(22) PCT Filed: Aug. 30, 2013

(86) PCT No.: PCT/JP2013/074005
§ 371 (c)(1),
(2) Date: Feb. 18, 2015

(87) PCT Pub. No.: WO2014/038644
PCT Pub. Date: Mar. 13, 2014

(65) Prior Publication Data

US 2015/0227066 A1 Aug. 13, 2015

(30) Foreign Application Priority Data

Sep. 10, 2012 (JP) ..... 2012-198096

(51) Int. Cl.
*G03G 9/087* (2006.01)
*G03G 9/08* (2006.01)
*G03G 9/093* (2006.01)
*G03G 9/107* (2006.01)

(52) U.S. Cl.
CPC ..... *G03G 9/0821* (2013.01); *G03G 9/0804* (2013.01); *G03G 9/0819* (2013.01); *G03G 9/0825* (2013.01); *G03G 9/0827* (2013.01); *G03G 9/08755* (2013.01); *G03G 9/08797* (2013.01); *G03G 9/093* (2013.01); *G03G 9/09371* (2013.01); *G03G 9/107* (2013.01); *G03G 2215/0607* (2013.01)

(58) Field of Classification Search
CPC ..... G03G 9/08755; G03G 9/0821; G03G 9/09371
USPC ..... 430/109.4
See application file for complete search history.

(56) References Cited

U.S. PATENT DOCUMENTS

| | | | | |
|---|---|---|---|---|
| 8,889,326 | B2 * | 11/2014 | Sugiura | G03G 9/08755 399/111 |
| 2010/0316948 | A1 | 12/2010 | Sakaguchi et al. | |
| 2012/0082926 | A1 | 4/2012 | Suzuki et al. | |
| 2012/0282000 | A1 | 11/2012 | Nakayama et al. | |
| 2013/0078563 | A1 | 3/2013 | Nakayama et al. | |
| 2013/0095422 | A1 | 4/2013 | Yamamoto et al. | |
| 2013/0115550 | A1 | 5/2013 | Amemori et al. | |
| 2013/0236828 | A1 | 9/2013 | Mizoguchi et al. | |

FOREIGN PATENT DOCUMENTS

| | | |
|---|---|---|
| JP | 04-024702 | 4/1992 |
| JP | 2007-025525 | 2/2007 |
| JP | 2009-133937 | 6/2009 |
| JP | 2009-151005 | 7/2009 |
| JP | 2011-18029 A | 1/2011 |
| JP | 2012-78423 A | 4/2012 |
| JP | 2012-093562 | 5/2012 |
| JP | 2012-128404 A | 7/2012 |
| JP | 2012-163590 | 8/2012 |
| WO | WO -2013/125450 A1 * | 8/2013 |

OTHER PUBLICATIONS

Japanese Patent Office J-PlatPat machine-assisted English-language translation of JP 2012-093562 (pub. May 2012).*
Information Offer Forms issued on Nov. 2, 2015 in Japanese Patent Application No. 2012-198096 with English translation.
International Search Report dated Dec. 10, 2013 in PCT/JP2013/074005 filed Aug. 30, 2013.

* cited by examiner

*Primary Examiner* — Janis L Dote
(74) *Attorney, Agent, or Firm* — Oblon, McClelland, Maier & Neustadt, L.L.P.

(57) ABSTRACT

A toner of the present invention includes at least a colorant and a resin, has crystallinity CX or 20 or greater, and has a dynamic viscoelasticity characteristic in which a logarithmic value Log G'(50) of storage elastic modulus (Pa) at 50° C. is from 6.5 to 8.0 and a logarithmic value Log G'(65) of storage elastic modulus (Pa) at 65° C. is from 4.5 to 6.0, when the dynamic viscoelasticity characteristic is measured by temperature sweep from 40° C., at a frequency of 1 Hz, at a strain amount control of 0.1%, and at a temperature elevating rate of 2° C./min.

13 Claims, 5 Drawing Sheets

TONER, IMAGE FORMING APPARATUS, IMAGE FORMING METHOD, PROCESS CARTRIDGE, AND DEVELOPER

CROSS-REFERENCE TO RELATED APPLICATIONS

This application is a National Stage of PCT/JP2013/074005, which was filed on Aug. 30, 2013. This application is based upon and claims the benefit of priority to Japanese Application No. 2012-198096, which was filed on Sep. 10, 2012.

TECHNICAL FIELD

The present invention relates to a toner, an image forming apparatus, an image forming method, a process cartridge, and a developer.

BACKGROUND ART

An image forming apparatus such as an electrophotographic apparatus and an electrostatic recording apparatus forms an image by developing an electrostatic latent image formed on a photoconductor with toners, transferring the developed toner image to a recording medium such as paper, and then fixing the toner image on the medium by heating. In the formation of a full-color image, generally, four colors of toners, namely, black, yellow, magenta, and cyan are used in development. After toner images of the respective colors are transferred to a recording medium and overlaid together, they are fixed on the medium by heating at the same time.

In order to reduce environmental impacts to the earth, toners are further required to have low-temperature fixability. If the softening characteristics of the toner are reformed to be set at a lower temperature in order to improve the low-temperature fixability, a problem occurs that the heat resistance storage stability of the toner is degraded. Degradation of the heat resistance storage stability of toner is a problem that the toner is solidified and cannot preserve its inherent flowability, when it has returned to room temperature after it melted under high-temperature, high-humidity conditions. Further, melting adhesion (hot offset) of a small amount of toner to the fixing member, which is likely to occur around the upper limit of the range of fixing temperatures, is more likely to occur. It has been difficult for the conventional toner to satisfy the low-temperature fixability and the heat-resistance storage stability at the same time.

Furthermore, if the softening characteristics of the toner are reformed to be set at a lower temperature, the developing stability of the toner is degraded. That is, the toner softens due to stirring stress in the development, and adheres to the developing member. It has also been difficult to overcome this problem at the same time as satisfying the above demands.

Meanwhile, it is known to use a crystalline resin as a binder resin of the toner for softening the toner (PTL 1). That is, a crystalline resin can rapidly soften at the melting point of the resin, which suggests that it might be possible to lower the softening temperature of the toner to around the melting point of the resin while securing the heat-resistance storage stability at equal to or lower than the melting point. However, it is actually very difficult to control the viscoelasticity at low temperatures. It is therefore very difficult to satisfy low-temperature fixability, heat resistance storage stability of the toner, hot offset resistance, and developing stability at the same time at high levels.

CITATION LIST

Patent Literature

PTL 1 Japanese Patent Application Publication JP-B No. 04-024702

SUMMARY OF INVENTION

Technical Problem

The present invention aims at solving the conventional problems described above and achieving the following object. That is, an object of the present invention is to provide a toner that achieves both an ultimate level of low-temperature fixability (particularly, under low-temperature, low-humidity conditions) and prevention of toner flowability degradation under high-temperature, high-humidity conditions at high levels, and that is suppressed from adhering to a toner developing member under high-temperature, high-humidity conditions.

Solution to Problem

Means for solving the problem is as follows. That is, provided is a toner, which contains at least a colorant and a resin, wherein the toner has crystallinity CX of 20 or greater, and a dynamic viscoelasticity characteristic in which a logarithmic value log G'(50) of storage elastic modulus (Pa) at 50° C. is from 6.5 to 8.0, and a logarithmic value log G'(65) of storage elastic modulus (Pa) at 65° C. is from 4.5 to 6.0, where the dynamic viscoelasticity characteristic is measured by temperature sweep from 40° C., at a frequency of 1 Hz, at a strain amount control of 0.1%, and at a temperature elevating rate of 2° C./min.

Advantageous Effects of Invention

According to the present invention, it is possible to solve the conventional problems, achieve the object described above, and provide a toner that achieves both an ultimate level of low-temperature fixability (particularly, under low-temperature, low-humidity conditions) and prevention of toner flowability degradation under high-temperature, high-humidity conditions at high levels, and that is suppressed from adhering to a toner developing member under high-temperature, high-humidity conditions.

DESCRIPTION OF EMBODIMENTS

Figure 1:
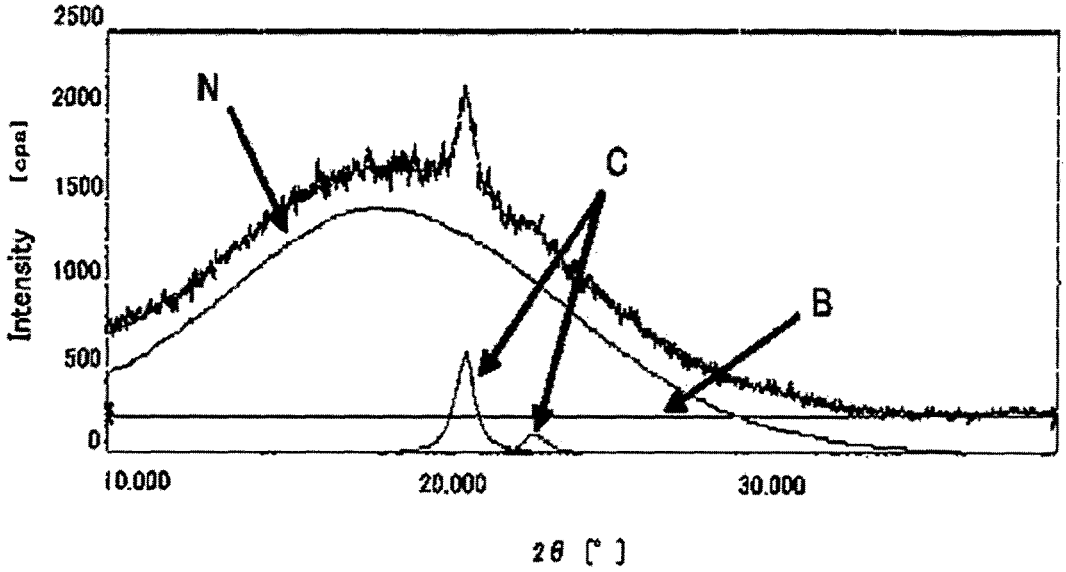
FIG. 1 is a diagram showing an example of X-ray crystal diffraction chart for measuring crystallinity of toner.

The present invention will now be described in detail below. Here, a toner, a manufacturing method and materials of a developing agent, and a whole system involved in an electrophotography process may be any conventional ones, as long as they satisfy conditions.

(Toner)

A toner of the present invention contains at least a colorant and a resin, and further contains other components such as a releasing agent, a charge controlling agent, external additives, and fine resin particles, if necessary. The toner has crystallinity CX of 20 or greater. The toner has a dynamic viscoelasticity characteristic in which a logarithmic value log G'(50) of storage elastic modulus (Pa) at 50° C. is from 6.5 to 8.0, and a logarithmic value log G'(65) of storage elastic modulus (Pa) at 65° C. is from 4.5 to 6.0, where the dynamic viscoelasticity characteristic is measured by temperature sweep from 40° C., at a frequency of 1 Hz, at a strain amount control of 0.1%, and at a temperature elevating rate of 2° C./min.

As a result of earnest studies, the present inventors have found out that if a toner containing at least a colorant and a resin is provided with crystallinity CX of 20 or greater and with a dynamic viscoelasticity characteristic in which a logarithmic value log G'(50) of storage elastic modulus (Pa) at 50° C. is from 6.5 to 8.0, and a logarithmic value log G'(65) of storage elastic modulus (Pa) at 65° C. is from 4.5 to 6.0 when measured by temperature sweep from 40° C., at a frequency of 1 Hz, at a strain amount control of 0.1%, and at a temperature elevating rate of 2° C./min, the toner can achieve an ultimate level of low-temperature fixability under low-temperature, low-humidity conditions, prevention of toner flowability degradation under high-temperature, high-humidity conditions, and prevention of adhesion to a developing member under high-temperature, high-humidity conditions, all at the same time at high levels.

The mechanism by which the toner of the present invention can achieve both an ultimate level of low-temperature fixability (particularly, under low-temperature-low-humidity conditions) and prevention of toner flowability degradation under high-temperature, high-humidity conditions at high levels, and can suppress adhesion to a developing member under high-temperature-high-humidity conditions is yet to be clarified, but the followings are estimated from some analytical data.

First, by providing the toner with crystallinity CX of 20 or greater, it becomes easier to obtain a steep melting characteristic. Further, by providing the toner with a dynamic viscoelasticity characteristic in which a logarithmic value log G'(50) of storage elastic modulus (Pa) at 50° C. is from 6.5 to 8.0, preferably from 6.5 to 7.5, more preferably from 6.8 to 7.4 when measured by temperature sweep from 40° C., at a frequency of 1 Hz, at a strain amount control of 0.1%, and at a temperature elevating rate of 2° C./min, it becomes possible to appropriately control the viscoelasticity of a range from room temperature to high-temperature conditions, and thereby to secure heat-resistance storage stability. When log G'(50) is lower than 6.5, the storage elastic modulus is so low that it becomes difficult to secure heat resistance storage stability and suppression of adhesion of the toner to the developing member under high-temperature, high-humidity conditions, which is unfavorable. On the other hand, when log G'(50) is higher than 8.0, the storage elastic modulus is sufficiently high and the toner hardness is improved. However, fixation of toner additives to the toner surface assisted by resin deformation is insufficient, and the toner additives come loose from the toner surface and cannot sufficiently exert the additives' inherent flowability and spacer effects, which leads to an unfavorable degradation of developing stability. If the toner is provided with a dynamic viscoelasticity characteristic in which a logarithmic value log G'(65) of storage elastic modulus (Pa) at 65° C. is from 4.5 to 6.0, preferably from 4.9 to 5.9, when measured by temperature sweep from 40° C., at a frequency of 1 Hz, at a strain amount control of 0.1%, and at a temperature elevating rate of 2° C./min, the melt viscoelasticity during fixation is sufficient, and low-temperature fixability is obtained, which is favorable. When the logarithmic value log G'(65) is lower than 4.5, the storage elastic modulus is too low, and unfavorably, allowance for hot offset is reduced. On the other hand, when the logarithmic value log G'(65) is higher than 6.0, deformation does not occur sufficiently relative to the quantity of heat during fixation, which unfavorably leads to insufficient image uniformity and insufficient image fixation strength.

The logarithmic value log G'(50) is a characteristic relevant to heat resistance storage stability, and is associated with the characteristics of a non-crystalline resin used and with the melting point and viscoelasticity of a crystalline resin. On the other hand, the logarithmic value log G'(65) is a characteristic relevant to low-temperature fixability, and is likewise associated with the characteristics of the non-crystalline resin used and with the melting point and viscoelasticity of the crystalline resin.

Accordingly, by controlling the characteristics and contents of the non-crystalline resin and crystalline resin used in the toner, it is possible to control the logarithmic values log G'(50) and log G'(65) to within the ranges of the present invention.

Further, toner evaluation for obtaining the intended toner can be performed not by outputting images using an actual apparatus every time, but by controlling the logarithmic values log G'(50) and log G'(65), which are the inherent characteristics of the toner itself, to the ranges of the present invention.

It is more preferable that the toner have tan δ(50) of 0.1 to 0.4 at 50° C., and tan δ(65) of 0.4 to 2.0 at 65° C., where tan δ indicates loss tangent (loss coefficient) defined by a ratio G"/G' between storage elastic modulus (G') and loss elastic modulus (G"). When tan δ(50) is lower than 0.1, the viscous characteristic is so low that the toner additives unfavorably do not fix well to the toner surface. When tan δ(50) is higher than 0.4, the viscosity is so high that it unfavorably becomes difficult to suppress adhesion of the toner to the developing member under high-temperature, high-humidity conditions. When tan δ(65) is lower than 0.4, the viscosity is so low that deformation is not sufficient relative to the quantity of heat during fixation, which unfavorably reduces image uniformity and image fixation strength. When tan δ(65) is higher than 2.0, the viscosity is so high that the allowance for hot offset is unfavorably reduced.

When a crystalline resin is used as a material resin to be melt, kneaded, and pulverized for manufacturing a toner, the problem is the extreme difficulty controlling the crystalline structure of the crystalline resin, which changes due to heat and stress when subjected to a high temperature during a melting and kneading process. This problem can be solved by granulating the material resin of the toner in a medium containing at least water, an organic solvent, or both thereof, which is further preferable because it becomes possible to control the toner to have the characteristics described above.

Further, it is more preferable that the toner contain ethyl acetate in an amount of 1 μg/g to 30 μg/g, because the low-temperature fixability of the toner is further promoted by a melting effect expressed by adhesion of a small amount of ethyl acetate to the toner. When the amount of ethyl acetate is smaller than 1 μg/g, no melting effect is promoted. The amount of ethyl acetate should preferably not be greater than 30 μg/g, because otherwise, the melting effect is excessively promoted to adversely affect the developing stability.

It is possible to add ethyl acetate in the toner by using ethyl acetate as a solvent for manufacturing the toner. It is possible to add ethyl acetate not only by using it as a solvent, but also by adding it in any other material or in other manufacturing step, or by adding it when manufacturing the toner. Any conventional method can be used as a method for removing the solvent, but it is important to appropriately control the remaining amount.

It is more preferable that a toner of the present invention have a core-shell structure, because it becomes easier to balance the heat resistance storage stability and the low-temperature fixability of the toner. Specifically, providing the core-shell structure more preferably makes it easier to control the toner characteristics, i.e., to control the logarithmic value log G'(50) to 6.5 to 8.0 and the logarithmic value log G'(65) to 4.5 to 6.0.

It is preferable that the toner contain at least a crystalline polyester resin, because more allowance can be obtained for the low-temperature fixability design, and toner flowability degradation under high-temperature, high-humidity conditions can be prevented.

Further, it is more preferable that the toner contain at least a modified polyester resin, because a low-temperature fixability design is possible, toner flowability degradation under high-temperature, high humidity conditions can be further prevented, and adhesion to the developing member can be suppressed.

It is more preferable that the toner have an average circularity E of 0.93 to 0.99, because toner flowability degradation under high-temperature, high-humidity conditions can be further prevented.

It is more preferable that the toner have a circularity SF-1 of 100 to 150 and a circularity SF-2 of 100 to 140, because toner flowability degradation under high-temperature, high-humidity conditions can be further prevented.

It is more preferable that the toner have a weight-average particle size D4 of 2 μm to 7 μm, and a ratio D4/Dn of 1.00 to 1.25 between the weight-average particle size D4 and a number-average particle size Dn, because toner flowability degradation under high-temperature, high-humidity conditions can be further prevented.

[Crystallinity CX of Toner]

The crystallinity CX of a toner of the present invention was measured by X-ray crystal diffraction. The apparatus used was a powder X-ray diffractometer D8 DISCOVER (X-ray diffraction system) manufactured by Bruker.

1) Measurement Conditions

Radiation source: Cu, Ka

Output: 45 kV, 110 mA

Collimator: 300 mmf double (metal collimator)

Distance of a detecting device: 25 cm

Range of measurement: 2 deg to 64 deg (2q)

2) Measurement

A sample holder was filled with the toner, and measurement was performed by rotating the sample holder in order to reduce influences of alignment and obtain a highly repeatable result.

3) Analysis

Fitting of a crystalline portion (peak, indicated by a symbol "C" in FIG. 1) and an amorphous portion (halo, indicated by a symbol "N" in FIG. 1) was performed (FIG. 1), and each integrated strength was substituted in the formula shown below to calculate the crystallinity CX. The symbol "B" in FIG. 1 indicates the background.

$$CX=Ic/(Ic+Ia)\times 100$$

where Ic is an integrated strength of crystal scattering, and Ia is an integrated strength of non-crystal scattering.

[Evaluation of Toner's Dynamic Viscoelasticity Characteristic]

The viscoelasticity characteristics of a toner of the present invention, namely the logarithmic value log G'(50) of storage elastic modulus (Pa) at 50° C., the logarithmic value log G'(65) of storage elastic modulus (Pa) at 65° C., and tan δ (loss tangent (loss coefficient) defined by the ratio G"/G' between storage elastic modulus (G') and loss elastic modulus (G")), including tan δ(50) at 50° C., and tan δ(65) at 65° C. can be evaluated as follows.

1) Sample

The toner was compression-molded into a tablet shape having a diameter of 10 mm and a thickness of 1 mm and used as a sample.

2) Evaluator

The sample described above was fixed on a parallel plate and evaluated by a dynamic viscoelasticity measuring apparatus ARES manufactured by TA Instruments.

3) Evaluation Conditions

Temperature sweep from 40° C.

Frequency: 1 Hz

Strain amount control: 0.1%

Temperature elevating rate: 2° C./min

[Qualitative and Quantitative Evaluations of Volatile Organic Compound]

It is preferable to perform qualitative and quantitative evaluations of a volatile organic compound of the present invention by cryotrap-GCMS method.

1) Apparatus: QP2010 manufactured by Shimadzu Corporation, Data analyzing software: GCMSSOLUTION manufactured by Shimadzu Corporation, Heating apparatus: PY2020D manufactured by Frontier Laboratories Ltd.

2) Amount of sample: 10 mg

3) Thermal extraction conditions; Heating temperature: 180° C., Duration of heating: 15 min 4) Cryotrap: −190° C.

5) Column: ULTRA ALLOY-5, L=30 m, ID=0.25 mm, Film=0.25 μm

6) Temperature elevation of the column: 60° C. (retained for 1 minute), by 10° C./min until 130° C., by 20° C./min until 300° C. (retained for 9.5 minutes)

7) Carrier gas pressure: constant at 56.7 kPa

8) Column flow rate: 1.0 ml/min

9) Ionization method: EI method (70 eV)

10) Mass range: m/z=29 to 700

[Recognition of Toner Core-Shell Structure]

It is preferable to evaluate recognition of a toner core-shell structure in the present invention by a method using a TEM (transmission electron microscope) described below. A core-shell structure is defined as a state of the toner surface being covered with a contrast component that is different from the toner interior. It is preferable that the thickness of the shell layer be 50 nm or greater.

First, about one spatulaful of toner was embedded and hardened in an epoxy resin. The sample was exposed to a gas for 1 minute to 24 hours using ruthenium tetroxide, osmium tetroxide, or another stain, to distinguishably stain the shell layer and the core interior. The duration of exposition was appropriately adjusted according to the contrast observed. A cross-section of the sample was exposed by a knife, and an ultra-thin section (having a thickness of 200 nm) of the toner was made by an ultramicrotome (manufactured by Leica, ULTRACUT UCT, using a diamond knife). After this, the ultra-thin section was observed by a TEM (transmission electro microscope; H7000; manufactured by Hitachi High-Technologies Corporation) at an accelerating voltage of 100 kV. Depending on the compositions of the shell layer and the core, they might be distinguishable without stains. In this case, they would be evaluated without stains. It is also possible to impart a contrast between the compositions by another means such as selective etching, and it is also preferable to perform TEM observation and shell layer evaluation after this kind of pretreatment.

[Average Circularity E]

The average circularity E of a toner of the present invention is defined by Circularity E=(Perimeter of a circle having the same area as a projected area of a particle/Perimeter of a projected image of a particle)×100%. The toner particles were measured by a flow particle image analyzer ("FPIA-2100" manufactured by Sysmex Corporation) and analyzed by analyzing software (FPIA-2100 Data Processing Program for FPIA version 00-10). Specifically, 0.1 mL to 0.5 mL of a 10% by mass surfactant (alkylbenzene sulfonate NEOGEN SC-A manufactured by Dai-ichi Kogyo Seiyaku Co., Ltd.) was added to a 100 mL glass beaker, 0.1 g to 0.5 g of each toner was added and stirred by a microspatula, and then 80 mL of ion-exchanged water was added. The obtained dispersion liquid was subjected to dispersion by an ultrasonic dispersion instrument (manufactured by Honda Electronics) for 3 minutes. Toner shapes and distributions were measured from the dispersion liquid until a concentration of 5,000 particles/μl to 15,000 particles/μl was observed by FPIA-2100 mentioned above. In terms of repeatability of average circularity measurement, it is important in this measuring method to obtain 5,000 particles/μl to 15,000 particles/μl as the concentration of the dispersion liquid. In order to obtain this dispersion liquid concentration, it is necessary to change the conditions of the dispersion liquid, i.e., the amount of the surfactant and the amount of the toner to be added. The amount of the surfactant required varies according to the hydrophobicity of the toner as in the measurement of the toner particle size described above. If the surfactant is added in a large amount, noise will occur due to bubbles, whereas if the amount added is insufficient, the toner cannot be wet enough, and hence cannot be dispersed sufficiently. The amount of the toner to be added varies according to the particle size. It is necessary to add a small amount if the particle size is small, and it is necessary to add a large amount if the particle size is large. When the toner particle size is 3 μm to 7 μm, it is possible to adjust the dispersion liquid concentration to 5,000 particles/μl to 15,000 particles/μl by adding the toner in an amount of 0.1 g to 0.5 g.

[Circularity SF-1, SF-2]

Shape factors SF-1 and SF-2, which indicate circularity used in the present invention, were defined as values resulting from the formulae shown below, obtained based on 300 FE-SEM images which were randomly sampled from FE-SEM images of a toner acquired as measured by FE-SEM (S-4200) (manufactured by Hitachi Ltd.) and which were fed to and analyzed by an image analyzer (LUZEX AP, manufactured by Nireco Corporation). It is preferable that SF-1 and SF-2 values be obtained by LUZEX, but the apparatuses are not particularly limited to the FE-SEM and the image analyzer mentioned above as long as similar analysis results can be obtained.

$$SF\text{-}1=(L^2/A)\times(\pi/4)\times 100$$

$$SF\text{-}2=(P^2/A)\times(1/4\pi)\times 100$$

where L indicates absolute maximum length of the toner, A indicates projected area of the toner, and P indicates maximum perimeter of the toner. Both of the factors become 100 if the toner is a sphere. As the values increase from 100, the shape deforms from a sphere to an indefinite shape. Particularly, SF-1 is a shape factor indicating the shape of the toner as a whole (an ellipse, a sphere, etc.), and SF-2 is a shape factor indicating the degree of irregularity on the surface.

[Weight-Average Particle Size and Ratio D4/Dn (Weight-Average Particle Size/Number-Average Particle Size)]

The weight-average particle size (D4) and the number-average particle size (Dn) of a toner, and their ratio (D4/Dn) can be measured by the method described below. The average particle size and particle size distribution of the toner can be measured by using a Coulter counter TA-II, and a Coulter multisizer II (both manufactured by Coulter, Inc.) Particularly, Coulter multisizer II was used in the present invention. The measuring method will now be described below.

First, as a dispersant, 0.1 mL to 5 mL of a surfactant (preferably, polyoxyethylenealkylether (a non-ionic surfactant)) is added to 100 mL to 150 mL of an electrolytic aqueous solution. The electrolytic solution is an about 1% NaCl aqueous solution prepared by using primary sodium chloride. For example, ISOTON-II (manufactured by Coulter, Inc.) can be used as the electrolytic solution. Then, 2 mg to 20 mg of the sample to be measured is added. The electrolytic solution in which the sample is suspended is subjected to dispersion by an ultrasonic dispersion instrument for about 1 minute to about 3 minutes. Then, by using the measuring apparatus mentioned above and using a 100 μm aperture, the volume and the number of toner particles or the toner are measured to calculate a volume distribution and a number distribution. The weight-average particle size (D4) and the number-average particle size of the toner can be calculated from the obtained distributions.

Channels to be used are 13 channels, namely channels of 2.00 μm or greater but less than 2.52 μm; 2.52 μm or greater but less than 3.17 μm; 3.17 μm or greater but less than 4.00 μm; 4.00 μm or greater but less than 5.04 μm; 5.04 μm or greater but less than 6.35 μm; 6.35 μm or greater but less than 8.00 μm; 8.00 μm or greater but less than 10.08 μm; 10.08 μm or greater but less than 12.70 μm; 12.70 μm or greater but less than 16.00 μm; 16.00 μm or greater but less than 20.20 μm; 20.20 μm or greater but less than 25.40 μm; 25.40 μm or greater but less than 32.00 μm; and 32.00 μm or greater but less than 40.30 μm, and the target particles are of a particle size of from 2.00 μm to less than 40.30 μm.

<Resin>

The crystallinity of the toner of the present invention needs to be 20 or greater, but it is preferable that the crystallinity be from 30 to 100, and it is more preferable that the crystallinity be from 40 to 100. Therefore, it is preferable that the toner contain a crystalline resin as the resin (binder resin). It is more preferable that the resin contains the crystalline resin in an amount of 40% by mass or greater, preferably 50% by mass or greater relative to the resin. The kind of the resin is not particularly restricted, and can be appropriately selected according to the purpose. The crystalline resin may be used in combination with a non-crystalline resin, and it is preferable that the main component of the resin be substantially the crystalline resin.

<<Crystalline Resin>>

The content of the crystalline resin in the resin is not particularly restricted as long as it is 40% by mass or greater, and can be appropriately selected according to the purpose. However, in terms of maximizing balanced achievement of excellent low-temperature fixability and heat resistance storage stability to be obtained by the crystalline resin, the content thereof is preferably 50% by mass or greater, more preferably 65% by mass or greater, still more preferably 80% by mass or greater, and particularly preferably 95% by mass or greater. When the content is less than 40% by mass, the resin cannot express its sharp responsiveness to heat in the viscoelasticity characteristic of the toner, and it becomes more difficult to realize balanced achievement of low-temperature fixability and heat resistance storage stability.

In the present invention, a crystalline material is defined as a material in which atoms and molecules are aligned in a spatially repeating pattern, and defined as a material that exhibits a diffraction pattern when subjected to a general X-ray diffractometer.

Without any particular restriction, any resin can be selected as the crystalline resin according to the purpose, as long as it has crystallinity. Examples include a polyester resin, a polyurethane resin, a polyurea resin, a polyamide resin, a polyether resin, a vinyl resin, and a modified crystalline resin. They may be used solely or two or more of them may be used in combination. Among them, a polyester resin, a polyurethane resin, a polyurea resin, a polyamide resin, and a polyether resin are preferable, a resin including at least either an urethane skeleton or an urea skeleton is preferable, and a linear polyester resin and a composite resin containing the linear polyester resin are preferable.

Preferable examples of the resin including at least either an urethane skeleton or an urea skeleton include the polyurethane resin, the polyurea resin, an urethane-modified polyester resin, and an urea-modified polyester resin. The urethane-modified polyester resin is obtained by reacting a polyester resin having an isocyanate group at its terminal with polyole. The urea-modified polyester resin is obtained by reacting a polyester resin having an isocyanate group at its terminal with amines. The maximum peak temperature of the melting heat of the crystalline resin is preferably from 45° C. to 70° C., more preferably from 53° C. to 65° C., and particularly preferably from 58° C. to 62° C., in terms of realizing balanced achievement of low-temperature fixability and heat resistance storage stability. When the maximum peak temperature is lower than 45° C., low-temperature fixability is fine but heat resistance storage stability is poor. When the maximum peak temperature is higher than 70° C., heat resistance storage stability is fine but low-temperature fixability is poor, conversely.

—Crystalline Polyester Resin—

In the present invention, it is preferable that a crystalline polyester resin shown below be contained in an amount of 40% by mass or higher or preferably 50% by mass or higher relative to the resin. The melting point of the crystalline polyester resin is preferably in the range from 45° C. to 70° C., more preferably in the range from 53° C. to 65° C., and still more preferably in the range form 58° C. to 62° C. When the melting point is lower than 45° C., low-temperature fixability is fine but heat resistance storage stability is poor. When the melting point is higher than 70° C., heat resistance storage stability is fine but low-temperature fixability is poor, conversely. The melting point of the crystalline polyester resin was obtained as the peak temperature of an endothermic peak detected by differential scanning calorimetry (DSC).

In the present invention, a material is said to have crystallinity if a crystalline peak is detected by X-ray crystal diffractometry.

For example, a differential scanning calorimeter (e.g., DSC-6220R manufactured by Seiko Instruments, Inc.) may be used to measure the melting point of the crystalline resin. The sample is heated from room temperature to 150° C. at a temperature elevating rate of 10° C./min, then left at 150° C. for 10 minutes, cooled to room temperature and left for 10 minutes, and again heated to 150° C. at a temperature elevating rate of 10° C./min. The peak temperature of an endothermic peak that appears after this can be detected as the melting point.

Measurement of the glass transition temperature of the resin can also be performed likewise. The glass transition temperature is at the intersection between a baseline extending below the glass transition point and a tangent line of a curve portion representing glass transition.

In the present invention, "a crystalline polyester resin" means not only a polymer which is 100% made of a polyester architecture, but also a polymer (copolymer) obtained by polymerizing a component constituting polyester and another component. However, in the latter case, the component other than polyester that constitutes the polymer (copolymer) is 50% by mass or lower.

The crystalline polyester resin used in a toner of the present invention is synthesized from, for example, a multivalent carboxylic acid component and a polyhydric alcohol component. In the present embodiment, a commercial product or a synthesized product may be used as the crystalline polyester resin.

Examples of the multivalent carboxylic acid component include, but are not limited to: aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid; aromatic dicarboxylic acids such as diacids such as phthalic acid, isophthalic acid, terephthalic acid, naphthalene-2,6-dicarboxylic acid, malonic acid, and mesakonin acid; and anhydride and lower alkyl ester of those listed above.

Examples of trivalent or higher carboxylic acids include: 1,2,4-benzenetricarboxylic acid, 1,2,5-benzenetricarboxylic acid, 1,2,4-naphthalenetricarboxylic acid; and anhydride and lower alkyl ester of those listed above. They may be used solely or two or more of them may be used in combination.

The crystalline polyester resin may contain, as an acid component, a dicarboxylic acid component having a sulphonic acid group, other than the aliphatic dicarboxylic acids and the aromatic dicarboxylic acids listed above. Further, the crystalline polyester resin may contain a dicarboxylic acid component having a double bond, other than the aliphatic dicarboxylic acids and the aromatic dicarboxylic acids listed above.

Preferred as the polyhydric alcohol component are aliphatic diols, and more preferred are linear aliphatic diols including 7 to 20 carbon atoms in the main chain. If the aliphatic diol is a branched one, the crystallinity of the polyester resin might be degraded and the melting point might be lowered. If the number of carbon atoms in the main chain is less than 7, the melting temperature of the aliphatic diol becomes high when the aliphatic diol is condensation-polymerized with an aromatic dicarboxylic acid, which would disadvantage the low-temperature fixability. If the number of carbon atoms in the main chain is more than 20, it becomes harder to procure the material for practical use. The number of carbon atoms in the main chain is more preferably 14 or less.

Specific examples of the aliphatic diol preferably used for synthesizing the crystalline polyester used in the toner of the present invention include but are not limited to ethylene glycol, 1,3-propanediol, 1,4-butanediol, 1,5-pentanediol, 1,6-hexanediol, 1,7-heptanediol, 1,8-octanediol, 1-9-nonanediol, 1,10-decanediol, 1,11-undecanediol, 1,12-dodecanediol, 1,13-tridecanediol, 1,14-tetradecanediol, 1,18-octadecanediol and 1,14-eicosanedecanediol. Among these, 1,8-octanediol, 1-9-nonanediol, and 1,10-decanediol are preferable in view of easy availability.

Examples of trihydric or higher alcohols include glycerine, trimethylolethane, trimethylolpropane, and pentaerythritol. They may be used solely or two or more of them may be used in combination.

It is preferred that the content of the aliphatic diol in the polyhydric alcohol component be 80 mol % or higher, more preferably 90 mol % or higher. If the content of the aliphatic diol is less than 80 mol %, the crystallinity of the polyester resin is degraded and the melting temperature is lowered, which might deteriorate toner-blocking prevention ability, image storage ability, and low-temperature fixability.

For optional purposes such as preparing an acid value and a hydroxyl value, it is possible to add a multivalent carboxylic acid and a polyhydric alcohol at the final stage of the synthesis. Examples of the multivalent carboxylic acid include: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acid such as cyclohexanedicarboxylic acid.

Examples of the polyhydric alcohol include: aliphatic diols such as ethylene glycol, diethylene glycol, triethylene glycol, propylene glycol, butanediol, hexanediol, neopenthyl glycol, and glycerin; alicyclic diols such as cyclohexanediol, cyclohexanedimethanol, and hydrogenated bisphenol A; and aromatic diols such as adduct of bisphenol A with ethylene oxide and adduct of bisphenol A with propylene oxide.

Production of the crystalline polyester resin can be performed by setting the polymerization temperature to 180° C. to 230° C. The reaction is promoted by reducing the pressure in the reaction system if necessary and removing water and alcohols produced from condensation.

If a polymerizable monomer does not dissolve or compatibly dissolve at the reaction temperature, it is possible to dissolve it by adding a solvent having a high boiling point as a solubilizing agent. A polycondensation reaction is promoted by distilling the solubilizing agent away. If there is a polymerizable monomer exhibiting a poor compatibility in a copolymerization reaction, it is possible to previously condense this poorly compatible polymerizable monomer with the acid or alcohol that is prepared to be condensed with this polymerizable monomer, before polycondensing it with the main component.

Examples of the catalyst that can be used in the production of the polyester resin include: alkali metal compounds such as sodium and lithium; alkaline-earth metal compounds such as magnesium and calcium; metal compounds such as zinc, manganese, antimony, titanium, tin, zirconium, and germanium; phosphite compounds; phosphate compounds; and amine compounds.

Specific examples include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributylantimony, formic acid tin, tin oxalate, tetraphenyltin, dibutyltindichloride, dibutyltinoxide, diphenyltinoxide, zirconium tetrabutoxide, zirconium naphthenate, zirconyl carbonate, zirconyl acetate, zirconyl stearate, octylic acid zirconyl, germanium oxide, triphenylphosphite, tris(2,4-di-t-butylphenyl)phosphite, ethyltriphenylphosphoniumbromide, triethylamine, and triphenylamine.

The acid value of the crystalline polyester resin used in the present invention (the quantity of KOH in mg necessary for neutralizing 1 g of resin) is preferably in the range from 3.0 mgKOH/g to 30.0 mgKOH/g, more preferably in the range from 6.0 mgKOH/g to 25.0 mgKOH/g, and still more preferably in the range from 8.0 mgKOH/g to 20.0 mgKOH/g.

If the acid value is less than 3.0 mgKOH/g, dispersibility in water is degraded, and manufacture of particles by wet process becomes very difficult. Further, because the stability of polymerized particles is significantly degraded when the particles are agglomerated, manufacture of the toner might be inefficient. On the other hand, if the acid value is greater than 30.0 mgKOH/g, the toner would have increased hygroscopicity and would be more susceptible to influences from the environment.

The weight-average molecular weight (Mw) of the crystalline polyester resin is preferably from 6,000 to 35,000. If the molecular weight (Mw) is less than 6,000, the toner might sink into the surface of the recording medium such as paper when fixed thereon to result in uneven fixation, or might weaken the strength of the fixed image to folding resistance. If the weight-average molecular weight (Mw) is greater than 35,000, the viscosity of the toner during melting becomes so high that a viscosity suitable for fixation might be reached at a high temperature, which would consequently result in degradation of the low-temperature fixability.

The weight-average molecular weight can be measured by gel permeation chromatography (GPC). The molecular weight measurement by GPC was performed by using GPC/HLC-8120 (manufactured by Tosoh Corporation) as a measuring apparatus, using a column TSKGEL SUPER HM-M (15 cm) (manufactured by Tosoh Corporation), and using a THF solvent. The weight-average molecular weight was calculated by applying a molecular weight calibration curve generated based on a monodisperse polystyrene standard sample to the result of the measurement.

It is preferable that the crystalline resin, which may be the crystalline polyester resin described above, contain as its main component (50% by mass or greater), a crystalline polyester resin synthesized by using an aliphatic polymerizable monomer (hereinafter may be referred to as "crystalline aliphatic polyester resin"). In this case, the composition ratio of the aliphatic polymerizable monomer that constitutes the crystalline aliphatic polyester resin is preferably 60 mol % or higher, more preferably 90 mol % or higher. Preferable examples of the aliphatic polymerizable monomer include the aliphatic diols and carboxylic acids listed above.

—Non-Crystalline Polyester Resin—

In the present invention, it is preferable that the binder resin of the toner contain at least the non-crystalline polyester resin to be mentioned below. Non-crystalline polyester resins include modified polyester resins and unmodified polyester resins. It is more preferable that the binder resin contain both of them.

—Modified Polyester Resin—

In the present invention, modified polyester resins mentioned below can be used as a polyester resin. For example, polyester prepolymer having an isocyanate group can be used. Examples of the polyester prepolymer (A) having an isocyanate group include a product obtained by reacting polyester with polyisocyanate (3), where the polyester is a polycondensation of a polyol (1) and a polycarboxylic acid (2), and has an active hydrogen group. Examples of the active hydrogen group contained in the polyester include hydroxyl groups (alcoholic hydroxyl groups and phenolic hydroxyl groups), amino groups, carboxyl groups, and mercapto groups. Of these, preferred are alcoholic hydroxyl groups.

Examples of the polyol (1) include diols (1-1) and trihydric or higher polyols (1-2), with (1-1) alone or a mixture containing (1-1) and a small amount of (1-2) being preferred. Examples of diols (1-1) include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); and adducts of the above-listed bisphenols with alkylene oxides (e.g., ethylene oxide, propylene oxide and butylene oxide). Of these, preferred are C2 to C12 alkylene glycols and alkylene oxide adducts of bisphenols. Particularly preferred are alkylene oxide adducts of bisphenols, and combinations of alkylene oxide adducts of bisphenols and C2 to C12 alkylene glycols.

Examples of the trihydric or higher polyols (1-2) include trihydric to octahydric or higher aliphatic polyalcohols (e.g., glycerin, trimethylolethane, trimethylolpropane, pentaerythritol and sorbitol); trihydric or higher phenols (e.g., trisphenol PA, phenol novolac and cresol novolac); and alkylene oxide adducts of the above trihydric or higher polyphenols.

Examples of the polycarboxylic acid (2) include dicarboxylic acids (2-1) and trivalent or higher polycarboxylic acids (2-2), with (2-1) alone or a mixture containing (2-1) and a small amount of (2-2) being preferred. Examples of dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acid). Of these, preferred are C4 to C20 alkenylenedicarboxylic acids and C8 to C20 aromatic dicarboxylic acids. Examples of trivalent or higher polycarboxylic acids (2-2) include C9 to C20 aromatic polycarboxylic acids (e.g., trimellitic acid and pyromellitic acid). Notably, polycarboxylic acids (2) reacted with polyols (1) may be acid anhydrides or lower alkyl esters (e.g., methyl ester, ethyl ester and isopropyl ester) of the above carboxylic acids The ratio between polyol (1) and polycarboxylic acid (2) is generally from 2/1 to 1/1, preferably from 1.5/1 to 1/1, more preferably from 1.3/1 to 1.02/1, in terms of the equivalent ratio [OH]/[COOH] of the hydroxyl group [OH] to the carboxyl group [COOH].

Examples of the polyisocyanate (3) include aliphatic polyisocyanates (such as tetramethylene diisocyanate, hexamethylene diisocyanate and 2,6-diisocyanate methylcaproate); alicyclic polyisocyanates (such as isophorone diisocyanate and cyclohexylmethane diisocyanate); aromatic diisocyanates (such as tolylene diisocyanate and diphenylmethane diisocyanate); aromatic aliphatic diisocyanates (such as $\alpha,\alpha,\alpha',\alpha'$-tetramethyl xylylene diisocyanate); isocyanurates; blocked polyisocyanates in which the above polyisocyanates are blocked with a phenol derivative, an oxime, or a caprolactam, and combinations of two or more of them.

The ratio of the polyisocyanate (3), as the equivalent ratio [NCO]/[OH) of isocyanate groups [NCO] to hydroxyl groups [OH] of the polyester having hydroxyl groups, is generally from 5/1 to 1/1, preferably from 4/1 to 1.2/1, more preferably from 2.5/1 to 1.5/1. When [NCO]/[OH] is more than 5, the low-temperature fixability of the toner degrades, but when the molar ratio of [NCO] is less than 1, the urea content in the modified polyester is so low that hot offset resistance is poor. The amount of the constituent components of the polyisocyanate (3) contained in the prepolymer (A) having an isocyanate group at its terminal is generally from 0.5% by mass to 40% by mass, preferably from 1% by mass to 30% by mass, more preferably from 2% by mass to 20% by mass. When the amount is less than 0.5% by mass, the hot offset resistance will degrade, and the heat resistance storage stability and the low-temperature fixability will both degrade. When the amount is more than 40% by mass, the low-temperature fixability will degrade.

The number of isocyanate groups included per molecule of the prepolymer (A) having isocyanate groups is generally from 1 or more, preferably from 1.5 to 3 on average, and more preferably from 1.8 to 2.5 on average. When the number is less than 1 per molecule, the molecular weight of the modified polyester will be lower after chain elongation, crosslinking or both thereof, and hot offset resistance will degrade.

[Production Method]

A prepolymer (A) containing an isocyanate group can be produced by the following method, etc. Polyol (1) and polycarboxylic acid (2) are heated to 150° C. to 280° C. in the presence of a conventional esterification catalyst (e.g., tetrabutoxy titanate, and dibutyl tin oxide), and generated water is distilled away, optionally under the reduced pressure, to thereby obtain polyester containing a hydroxyl group. Next, the polyester containing a hydroxyl group is allowed to react with polyisocyanate (3) at 40° C. to 140° C., to thereby obtain prepolymer (A) containing an isocyanate group.

—Crosslink Agent and Elongation Agent—

In the present invention, amines can be used as a crosslink agent, an elongation agent, or both thereof. Examples of amines (B) include diamine (B1), trivalent or higher polyamine (B2), amino alcohol (B3), amino mercaptan (B4), amino acid (B5), and a blocked compound (B6) where an amino group of any of the amines B1 to B5 is blocked. Examples of diamine (B1) include: aromatic diamine (e.g., phenylene diamine, diethyltoluene diamine, and 4,4'-diaminodiphenyl methane), alicyclic diamine(4,4'-diamino-3,3'-dimethyldicyclohexyl methane, diamine cyclohexane, and isophorone diamine), and aliphatic diamine (e.g., ethylene diamine, tetramethylene diamine, and hexamethylene diamine). Examples of trivalent or higher polyamine (B2) include diethylene triamine, and triethylene tetramine.

Examples of the amino alcohol (B3) include ethanol amine, and hydroxyethyl aniline. Examples of amino mercaptan (B4) include aminoethylmercaptan, and aminopropylmercaptan. Examples of amino acid (B5) include amino propionic acid, and amino caproic acid. Examples of the blocked compound (B6) where an amino group of any of the amines B1 to B5 is blocked include a ketimine compound and oxazoline compound obtained from the amines and ketones of B1 to B5 (e.g., acetone, methyl ethyl ketone, and methyl isobutyl ketone). Among the aforementioned amines (B), B1 and a mixture of B1 and a small amount of B2 are preferable.

In the crosslink, elongation, or both thereof, if necessary, a terminating agent may be used to adjust the molecular weight of the modified polyester to result from the reaction. Examples of the terminating agent include monoamines (diethylamine, dibutylamine, butylamine, and laurylamine), and any of the monoamines that is blocked (a ketimine compound).

The ratio of the amine (B), as the equivalence ratio [NCO]/[NHx] of isocyanate groups [NCO] in the prepolymer (A) having isocyanate groups to amino groups [NHx] in the amine (B), is generally from ½ to 2/1, preferably from 1.5/1 to 1/1.5, more preferably from 1.2/1 to 1/1.2. When the [NCO]/[NHx] is greater than 2 or less than ½, the molecular weight of urea-modified polyester (i) is low and the hot offset resistance degrades.

—Modified Polyester—

In the present invention, it is more preferable to add an unmodified polyester (C) together with the modified polyester (A) as the toner binder components, than to use the modified polyester (A) solely. The combined use of (C) will improve the low-temperature fixability, and the lustrous property and lustrous uniformity when the toner is used for a full-color apparatus. Examples of (C) include a polycondensation of such polyol (1) and polycarboxylic acid (2) as those used as the components of the polyester (A), and preferred ones are likewise those used as the components of (A). Further, examples of (C) may include not only unmodified polyesters but also polyesters modified with a chemical bond other than an urea bond. For example, polyesters may be modified with an urethane bond. It is preferable that (A) and (C) compatibly dissolve at least partially in terms of low-temperature fixability and hot offset resistance. Therefore, it is preferable that the polyester component of (A) and (C) have similar compositions. In adding (A), the mass ratio between (A) and (C) is generally from 5/95 to 75/25, preferably from 10/90 to 25/75, more preferably from 12/88 to 25/75, and particularly preferably from 12/88 to 22/78. When the mass ratio of (A) is less than 5%, the hot offset resistance will degrade, and balanced achievement of the heat resistance storage stability and the low-temperature fixability will be disadvantaged.

The peak molecular weight of (C) is preferably from 1,000 to 30,000, more preferably from 1,500 to 10,000, particularly preferably from 2,000 to 8,000. When the peak molecular weight is lower than 1,000, the heat resistance storage stability of the toner may be degraded. Whereas when the peak molecular weight exceeds 10,000, the low-temperature fixing property of the toner may be degraded. The hydroxyl value of (C) is preferably 5 or greater, more preferably from 10 to 120, and particularly preferably from 20 to 80. When the hydroxyl value is less than 5, balanced achievement of the heat resistance storage stability and the low-temperature fixability will be disadvantaged. The acid value of (C) is generally from 0.5 to 40, preferably from 5 to 35. Providing acid value gives an inclination to be charged negatively. Further, an acid value and a hydroxyl value that are not included in the mentioned ranges will increase susceptibility to influences from the environment under high-temperature, high-humidity or low-temperature, low-humidity conditions, leading to image degradation.

In the present invention, the glass transition temperature (Tg) of a toner is generally from 40° C. to 70° C., preferably from 45° C. to 55° C. When the glass transition temperature is lower than 40° C., the heat resistance storage stability of the toner will be degraded. When it is higher than 70° C., the low-temperature fixing property will be insufficient. An electrostatic charge image developing toner of the present invention, which contains a crosslinked polyester resin, an elongated polyester resin, or a crosslinked and elongated polyester resin, exhibits better storage property than conventional polyester-based toners, even when the glass transition temperature is low. The toner has a storage elastic modulus of 10,000 dyne/cm$^2$ at a glass transition temperature (TG') of generally 100° C. or higher, preferably 110° C. to 200° C., when measured at a frequency of 20 Hz. When the glass transition temperature is lower than 100° C., hot offset resistance will degrade. The toner has a viscosity of 1,000 poise at a temperature (Tη) of generally 180° C. or lower, preferably 90° C. to 160° C., when measured at a frequency of 20 Hz. When the temperature exceeds 180° C., the low-temperature fixability will degrade. That is, in terms of realizing balanced achievement of the low-temperature fixability and hot offset resistance, it is preferable that TG' be higher than Tη. In other words, it is preferable that the difference between TG' and Tη (TG'-Tη) be 0° C. or more. A difference of 10° C. or more is more preferable, and a difference of 20° C. or more is particularly preferable. The upper limit of the difference is not particularly limited. In terms of balanced achievement of the heat-resistance storage stability and the low-temperature fixability, the difference between TG' and Tη is preferably from 0° C. to 100° C., more preferably from 10° C. to 90° C., and particularly preferably from 20° C. to 80° C.

—Vinyl Resin—

In the present invention, it is preferable to add any vinyl resin mentioned below in the toner, and it is more preferable to add any vinyl resin mentioned below in the binder resin of the shell. Examples of the vinyl resin include polymer produced through homopolymerization or copolymerization of vinyl monomers, such as styrene-(meth)acrylate resins, styrene-butadiene copolymers, (meth)acrylic acid-acrylate polymers, styrene-acrylonitrile copolymers, styrene-maleic anhydride copolymers and styrene-(meth)acrylic acid copolymers.

Other examples include: styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; and polybutyl methacrylates <Colorant>

All conventional dyes and pigments can be used as a colorant of the present invention. Examples of the colorant include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture of two or more of the preceding colorants. An amount of the colorant is preferably from 1% by mass to 15% by mass, more preferably from 3% by mass to 10% by mass, relative to the toner.

The colorant used in the present invention may be used as a master batch in which the colorant forms a composite with a resin. Examples of the binder resin kneaded in the production of, or together with the master batch include the aforementioned modified and unmodified polyester resins, styrene polymers or substituted products thereof (e.g., polystyrene, poly-p-chlorostyrene, and polyvinyl toluene); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used independently, or in combination.

The master batch can be prepared by mixing and kneading the colorant with the resin for the master batch under a high shearing force. In the mixing and kneading, an organic solvent may be used for improving the interactions between the colorant and the resin. Moreover, the master batch can be prepared by a flashing method of mixing and kneading an aqueous paste containing colorant water with a resin and an organic solvent to transfer the colorant to the resin while removing the water and the organic solvent. This method is preferably used because a wet cake of the colorant is used as it is, and it is not necessary to dry the wet cake of the colorant to prepare a colorant. In the mixing and kneading, a high-shearing disperser (e.g., a three-roll mill) is preferably used.

<Other Components>

<<Releasing Agent>>

A typical wax can be used as a releasing agent of the present invention. Conventional waxes can be used, and examples thereof include polyolefin waxes (e.g., polyethylene wax and polypropylene wax); long-chain hydrocarbon (e.g., paraffin waxes and SASOL wax); and carbonyl group-containing wax. Of these, carbonyl group-containing wax is preferred. Examples of the carbonyl group-containing wax include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., trimellitic acid tristearylamide); and dialkyl ketones (e.g., distearyl ketone). Of these carbonyl group-containing waxes, polyalkanoic acid esters are preferred. The melting point of a wax of the present invention is typically from 40° C. to 160° C., preferably from 50° C. to 120° C., and more preferably from 60° C. to 90° C. When the melting point thereof is lower than 40° C., the wax may adversely affect the heat resistance storage stability. When it is higher than 160° C., cold offset is easily caused upon fixing at low temperatures. The melt viscosity of the wax is preferably from 5 cps to 1,000 cps, more preferably from 10 cps to 100 cps, as measured at a temperature higher by 20° C. than the melting point. When the melt viscosity of the wax is more than 1,000 cps, the wax cannot exhibit the effects of improving hot offset resistance and low-temperature fixing property. The amount of the wax contained in the toner is preferably from 0% by mass to 40% by mass, more preferably from 3% by mass to 30% by mass.

<<Charge Controlling Agent>>

The toner of the present invention may contain a charge controlling agent, if necessary. Any conventional charge controlling agent can be used. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by CLARIANT K.K.); LRA-901; boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

In the present invention, the amount of the charge controlling agent contained is not determined flatly and is varied depending on the type of the binder resin used, on an optionally used additive, and on the toner production method used (including the dispersion method used). The amount of the charge controlling agent is preferably from 0.1 parts by mass to 10 parts by mass, more preferably from 0.2 parts by mass to 5 parts by mass, relative to 100 parts by mass of the binder resin. When the amount thereof is larger than 10 parts by mass, the charging ability of the toner becomes excessive, which may reduce the effect of the charge controlling agent, increase electrostatic force to a developing roller, leading to low flowability of the developer, or low image density of the resulting image. These charge controlling agents may be dissolved and dispersed after being melted and kneaded together with the master batch, and resin. The charge controlling agents can be, of course, directly added to an organic solvent when dissolution and dispersion is performed. Alternatively, the charge controlling agents may be fixed on surfaces of toner particles after the production of the toner particles.

<<External Additives>>

As an additive for assisting flowability, developability, and chargeability of colored particles obtained in the present invention, oxide particles, and in combination thereof, fine inorganic particles and hydrophobized fine inorganic particles can be used. It is more preferable that the additive contain at least one or more kinds of fine inorganic particles of which hydrophobized primary particles have an average particle size of 1 nm to 100 nm, more preferably 5 nm to 70 nm. It is further preferable that the additive contain at least one or more kinds of fine inorganic particles of which hydrophobized primary particles have an average particle size of 20 nm or smaller, and contain at least one or more kinds of fine inorganic particles whose hydrophobized primary particles have an average particle size of 30 nm or greater. It is also preferable that the specific surface of these particles measured by BET method be from 20 $m^2/g$ to 500 $m^2/g$.

Any conventional particles can be used as long as they satisfy these conditions. For example, the additive may include silica fine particles, hydrophobic silica, fatty acid metal salts (e.g., zinc stearate and aluminum stearate), metal oxides (e.g., titania, alumina, tin oxide, and antimony oxide), fluoropolymer, etc.

Examples of particularly preferred additives include hydrophobized silica, titania, titanium oxide, and alumina fine particles. Examples of the silica fine particles include HDK H 2000, HDK H 2000/4, HDK H 2050EP, HVK21, HDK H 1303 (manufactured by CLARIANT K.K.), and R972, R974, RX200, RY200, R202, R805, R812 (manufactured by Nippon Aerosil Co., Ltd.). Examples of the titania fine particles include P-25 (manufactured by Nippon Aerosil Co., Ltd.), STT-30, STT-65C-S (manufactured by Titan Kogyo Ltd.), TAF-140 (manufactured by Fuji Titanium Industry, Co., Ltd.), and MT-150W, MT-500B, MT-600B, MT-150A (manufactured by Tayca Corp.) Particular examples of the hydrophobized titanium oxide fine particles include T-805 (manufactured by Nippon Aerosil Co., Ltd.), STT-30A, STT-65S-S (manufactured by Titan Kogyo, Ltd.), TAF-500T, TAF-1500T (manufactured by Fuji Titanium Industry Co., Ltd.), MT-100S, MT-100T (manufactured by Tayca Corp.), and IT-S (manufactured by Ishihara Sangyo Kaisha Ltd.).

Hydrophobized oxide fine particles, silica fine particles, and titania fine particles and alumina fine particles can be obtained by treating hydrophilic fine particles with a silane coupling agent such as methyltrimethoxysilane, methyltriethoxysilane, and octyltrimethoxysilane. Silicone-oil treated oxide fine particle and fine inorganic particles, which are obtained by treating fine inorganic particles with a silicon oil while applying heat if necessary, are also preferable.

Examples of the silicone oil include dimethylsilicone oil, methylphenylsilicone oil, chlorophenylsilicone oil, methylhydrogensilicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acrylic, methacrylic-modified silicone oil, and α-methylstyrene-modified silicone oil. Examples of fine inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Among them, silica and titanium dioxide are particularly preferred. The additive amount thereof may be from 0.1% by mass to 5% by mass, preferably from 0.3% by mass to 3% by mass relative to the toner. The average particle size of the primary particle of the fine inorganic particles is 100 nm or smaller, preferably from 3 nm to 70 nm. When the average particle size is smaller than this range, the fine inorganic particles are buried in the toner, and cannot perform its function effectively. When the average particle size is greater than this range, the surface of the photoconductor is unfavorably unevenly damaged.

Other examples of the fine inorganic particles include fine polymeric particles, such as polycondensed thermosetting resin polymeric particles manufactured by soap-free emulsification polymerization, suspension polymerization, and dispersion polymerization, such as polystyrene, methacrylic acid ester, acrylic acid ester copolymer, silicone, benzoguanamine, and nylon.

If such fluidizers are surface-treated to improve hydrophobicity, degradation of fluidizing property and charging ability can be prevented even under high-humidity conditions. Examples of preferable surface treating agents include a silane coupling agent, a silylation agent, a silane coupling agent having an alkyl fluoride group, an organic titanate coupling agent, an aluminum coupling agent, silicone oil, and modified silicone oil.

Examples of the cleaning improving agent for removing the developer remained on the photoconductors and the first transfer member after the transferring include: fatty acid metal salts such as zinc stearate, calcium stearate, stearic acid; and polymer particles produced by soap-free emulsification polymerization, such as polymethyl methacrylate particles, and polystyrene particles. As for the polymer particles, polymer particles having a relatively narrow particle size distribution and the volume average particle diameter of 0.01 μm to 1 μm are preferably used.

<<Fine Resin Particles>>

In the present invention, it is also possible to add fine resin particles, if necessary. The fine resin particles to be used have a preferable glass transition point (Tg) of 40° C. to 100° C., and a preferable weight-average molecular weight of 3,000 to 300,000. When the glass transition point (Tg) is lower than 40° C., when the weight-average molecular weight is less than 3,000, or under both these conditions, the storage property of the toner will degrade as described above, and the toner will be blocked when stored or in a developing apparatus. When the glass transition point (Tg) is 100° C. or higher, when the weight-average molecular weight is 300,000 or greater, or under both of these conditions, the fine resin particles will inhibit adhesiveness with the fixing paper and will raise the lower limit fixing temperature.

It is further preferable that the residual ratio of the fine resin particles in the toner particles be from 0.5% by mass to 5.0% by mass. When the residual ratio is less than 0.5% by mass, the storage property of the toner will degrade and the toner will be blocked when stored or in a developing apparatus. When the residual ratio is greater than 5.0% by mass, the fine resin particles will inhibit oozing of the wax, resulting in an offset because the wax cannot exert its releasing effect.

In the measurement of the residual ratio of the fine resin particles, a pyrolysis gas chromatograph mass spectrometer may be used to analyze a substance attributable not to the toner particles but to the fine resin particles, and the ratio can be calculated from the detected peak area. The detector is preferably a mass spectrometer, but is not particularly limited.

Any resin can be used for the fine resin particles, as long as it can form an aqueous dispersing element. The resin may be a thermoplastic resin or may be a thermosetting resin. Examples include vinyl resins, polylactic resins, polyurethane resins, epoxy resins, polyester resins, polyamide resins, polyimide resins, silicon resins, phenol resins, melamine resins, urea resins, aniline resins, ionomer resins, and polycarbonate resins. Two or more of the above resins may be used in combination for the fine resin particles. Of the above resins, preferred are vinyl resins, polyurethane resins, epoxy resins, polyester resins, and their combinations, because an aqueous dispersing element of fine spherical resin particles can be easily obtained from them.

Examples of vinyl resins include polymer produced through homopolymerization or copolymerization of vinyl monomers, such as styrene-(meth)acrylate resins, styrene-butadiene copolymers, (meth)acrylic acid-acrylate polymers, styrene-acrylonitrile copolymers, styrene-maleic anhydride copolymers and styrene-(meth)acrylic acid copolymers.

A dry toner of the present invention can be manufactured by, but not limited to, the method described below.

[Toner Manufacturing Method in Aquatic Medium]

It is preferable that toner particles of a toner of the present invention be manufactured by granulation in a medium containing at least water, an organic solvent, or both thereof. It is more preferable that toner particles be manufactured by dissolving suspension, and yet more preferably by dissolving suspension involving at least an elongation reaction.

A preferable method of dissolving suspension involving an elongation reaction may be to granulate an oil phase containing at least a crystalline resin and a binder resin precursor by dispersion, emulsification, or both thereof in an aquatic medium. A more preferable method is to promote crosslinking, elongation, or both thereof of the toner composition containing at least the polyester prepolymer (A) having the isocyanate group, a crystalline polyester resin, a colorant, and a releasing agent in an aquatic medium in the presence of fine resin particles.

A preferable example of the organic solvent is ethyl acetate. Other examples of the solvent include methyl acetate, THF (tetrahydrofuran), toluene, acetone, methanol, ethanol, propanol, butanol, isopropyl alcohol, hexane, tetrachloroethylene, chloroform, diethylether, methylene chloride, dimethylsulfoxide, acetonitrile, acetic acid, formic acid, N,N-dimethylformamide, benzene, methylethylketon, and any organic solvent in which an oil phase containing a resin, a colorant, etc. can dissolve or disperse.

Preferably, an aqueous phase to be used in the present invention may be previously mixed with fine resin particles, before used. Functioning as a particle size controlling agent, the fine resin particles surround the toner and finally will coat the toner surface and serve as a shell layer. To have the fine resin particles fully function as the shell layer, minute control is required because the functionality is influenced by the particle size and composition of the fine resin particles, the dispersant (surfactant) in the aqueous phase, the solvent, etc.

An aqueous phase may contain water alone, or a combination of water and a solvent miscible with water. Examples of the solvent miscible with water include alcohol (e.g., methanol, isopropanol, and ethylene glycol), dimethyl formamide, tetrahydrofuran, cellosolves (e.g., methyl cellosolve), and lower ketones (e.g., acetone, and methyl ethyl ketone).

It is possible to form toner particles by reacting with the amines (B), a dispersing element containing the polyester prepolymer (A) having the isocyanate group that is dissolved or dispersed in an organic solvent in an aqueous phase. The method for stably forming a dispersing element containing the polyester prepolymer (A) in an aqueous phase may be to add a toner material composition containing the polyester prepolymer (A) dissolved or dispersed in an organic solvent to an aqueous phase, and disperse the composition under a shearing force. In the formation of the dispersing element in the aqueous phase, the polyester prepolymer (A) dissolved or dispersed in an organic solvent may be mixed with other toner compositions (hereinafter referred to as toner materials) such as a colorant, a coloring master batch, a releasing agent, a charge controlling agent, and an unmodified polyester resin. However, it is more preferable to mix the toner materials and dissolve or disperse them in an organic solvent beforehand, and after this, add and disperse the mixture in the aqueous phase. Further, in the present invention, it is not indispensable to have had the other toner materials such as the colorant, the releasing agent, and the charge controlling agent mixed when forming particles in the aqueous phase, but it is possible to add them after particles are formed. For example, it is also possible to add a colorant by a conventional dyeing method, after particles not containing a colorant are formed.

The method of dispersing is not particularly restricted, and examples thereof may use any conventional instruments for dispersing, such as by means of low-speed shearing, high-speed shearing, friction, high-pressure jetting and an ultrasonic wave. When a high-speed shearing disperser is used, the rotating speed is not particularly restricted, but is typically from 1,000 rpm to 30,000 rpm, more preferably, from 5,000 rpm to 20,000 rpm. The duration for dispersing is not particularly restricted, but in the case of the batch system, it is typically from 0.1 minutes to 5 minutes. The temperature for dispersing is typically preferably from 0° C. to 150° C. (under pressure), more preferably from 40° C. to 98° C. A higher temperature is preferable because the dispersing element containing the polyester prepolymer (A) will have a lower viscosity and will be easily dispersed.

The content of the aqueous phase is generally from 50 to 2,000 parts by mass, preferably from 100 to 1,000 parts by mass, relative to 100 parts by mass of the toner composition containing the polyester prepolymer (A). When the content is less than 50 parts by mass, the toner composition will disperse insufficiently, making it impossible to obtain toner particles having a predetermined particle size. On the other hand, it is uneconomical when the content is greater than 2,000 parts by mass. It is possible to use a dispersant, if necessary. It is more preferable to use a dispersant, because the particle size distribution will be sharp and dispersion will be stable.

Examples of the dispersant for emulsifying and dispersing the oil phase, in which the toner material is dispersed, in the aqueous phase, include; anionic surfactants such as alkyl benzene sulfonic acid salts, α-olefin sulfonic acid salts and phosphoric acid esters; amine salts such as alkyl amine salts, amino alcohol fatty acid derivatives, polyamine fatty acid derivatives and imidazoline; quaternary ammonium salt cationic surfactants such as alkyltrimethylammonium salts, dialkyldimethylammonium salts, alkyl dimethyl benzyl ammonium salts, pyridinium salts, alkyl isoquinolinium salts and benzethonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine.

Also, a fluoroalkyl group-containing surfactant can exhibit its dispersing effects even in a small amount. Preferable examples of the fluoroalkyl group-containing anionic surfactant include C2-C10 fluoroalkyl carboxylic acid or a metal salt thereof, disodium perfluorooctane sulfonyl glutamate, sodium 3-[ω-fluoroalkyl(C6-C11)oxy)-1-alkyl(C3-C4) sulfonate, sodium 3-[ω-fluoroalkanoyl(C6-C8)-N-ethylamino]-1-propanesulfonate, fluoroalkyl(C11-C20) carboxylic acid or a metal salt thereof, perfluoroalkylcarboxylic acid(C7-C13) or a metal salt thereof, perfluoroalkyl (C4-C12)sulfonate or a metal salt thereof, perfluorooctanesulfonic acid diethanol amide, N-propyl-N-(2-hydroxyethyl) perfluorooctanesulfone amide, perfluoroalkyl(C6-C10) sulfoneamidepropyltrimethylammonium salt, a salt of perfluoroalkyl(C6-C10)-N-ethylsulfonylglycin and monoperfluoroalkyl(C6-C16)ethylphosphate. Examples of commercial products of the fluoroalkyl group-containing surfactant include: SURFLON S-111, S-112, S-113 (manufactured by Asahi Glass Co., Ltd.); FRORARD FC-93, FC-95, FC-98, FC-129 (manufactured by Sumitomo 3M Ltd.); UNIDYNE DS-101, DS-102 (manufactured by Daikin Industries, Ltd.); MEGAFACEF-110, F-120, F-113, F-191, F-812, F-833 (manufactured by DIC Corporation); EFTOP EF-102, 103, 104, 105, 112, 123A, 123B, 306A, 501, 201, 204 (manufactured by Tohchem Products Co., Ltd.); and FUTARGENT F-100, F150 (manufactured by NEOS COMPANY LIMITED).

Examples of the cationic surfactant include an aliphatic primary, secondary or tertiary amine acid containing a fluoroalkyl group, aliphatic quaternary ammonium salt such as perfluoroalkyl(C6-C10)sulfonic amide propyl trimethyl ammonium salt, benzalkonium salt, benzetonium chloride, pyridinium salt and imidazolinium salt. Examples of commercial products of the cationic surfactant include: SURFLON S-121 (manufactured by Asahi Glass Co., Ltd.); FRORARD FC-135 (manufactured by Sumitomo 3M Ltd.); UNIDYNE DS-202 (manufactured by Daikin Industries, Ltd.); MEGAFACE F-150, F-824 (manufactured by DIC Corporation); EFTOP EF-132 (manufactured by Tohchem Products Co., Ltd.); and FUTARGENT F-300 (manufactured by NEOS COMPANY LIMITED).

As for a water-insoluble inorganic compound dispersant, tricalcium phosphate, calcium carbonate, titanium oxide, colloidal silica, and hydroxyapatite can be used.

The dispersed droplets may be, moreover, stabilized with polymer protective colloid. Examples of the dispersion stabilizer for use include: acids such as acrylic acid, methacrylic acid, α-cyanoacrylic acid, α-cyanomethacrylic acid, itaconic acid, crotonic acid, fumaric acid, maleic acid and maleic anhydride; (meth)acryl monomer containing a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acryl amide, and N-methylol methacryl amide; vinyl alcohol or ethers with vinyl alcohol, such as vinyl methyl ether, vinyl ethyl ether, and vinyl propyl ether; ester of vinyl alcohol and a compound containing a carboxyl group, such as vinyl acetate, vinyl propionate, and vinyl butyrate; acryl amides, such as acryl amide, methacryl amide, diacetone acryl amide or methylol compounds of the preceding amides; acid chlorides, such as acrylic acid chloride, and methacrylic acid chloride; a homopolymer or copolymer containing a nitrogen atom or its heterocycle, such as vinyl pyridine, vinyl pyrrolidone, vinyl imidazole, and ethylene imine; polyoxyethylenes, such as polyoxy ethylene, polyoxypropylene, polyoxy ethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester; and celluloses such as methyl cellulose, hydroxyethyl cellulose, and hydroxypropyl cellulose.

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed fine particles. Also, the calcium phosphate may be removed through enzymatic decomposition.

Alternatively, the dispersing agent used may remain on the surfaces of the toner particles. The dispersing agent is, however, preferably removed through washing after an elongation reaction, a crosslinking reaction, or elongation and crosslinking reactions in terms of chargeability of the resulting toner.

The duration for an elongation reaction, a crosslink reaction, or elongation and crosslink reactions is selected depending on the reactivity between the isocyanate group structure contained in the prepolymer (A) and the amines (B), but it is typically from 10 minutes to 40 hours, preferably from 2 hours to 24 hours. The reaction temperature is typically from 0° C. to 150° C., preferably from 40° C. to 98° C. A conventional catalyst can be moreover used for the elongation reaction, the crosslink reaction, or the elongation and crosslink reactions, if necessary. Specific examples of the catalyst include dibutyl tin laurate and dioctyl tin laurate.

In order to remove the organic solvent from the obtained emulsified dispersing element, the following method can be employed. The method includes gradually heating the entire system to evaporate the organic solvent contained in the droplets, such that the droplets contain ethyl acetate in an amount of 1 μg/g to 30 μg/g. Alternatively, the emulsified dispersing element is sprayed in a dry atmosphere to remove the water-insoluble organic solvent contained in the droplets such that the droplets contain ethyl acetate in an amount of 1 μg/g to 30 μg/g, thereby to form toner particles at the same time as evaporating and removing the aquatic dispersant. As for the dry atmosphere to which the emulsified dispersion liquid is sprayed, heated gas (e.g., air, nitrogen, carbon dioxide and combustion gas), particularly various air flow heated at the temperature equal to or higher than the highest boiling point of the solvent are generally used. A treatment of a short period using a spray drier, belt dryer, or rotary kiln can sufficiently achieve the intended quality.

The method for removing the organic solvent may be to remove by an air blown by a rotary evaporator or the like.

A drying method for keeping ethyl acetate remained may be to select a drying temperature, a duration of drying, and a drying manner (airflow drying, stationary drying, shelf drying, reduced pressure drying, and indirect drying) in various combinations, to monitor the remaining amount of ethyl acetate according to the toner manufacturing state and optimize the degree of the dried state.

After this, the dispersing element is subjected to repeating steps of crude separation by centrifugal separation, washing of the emulsified dispersing element in a washing tank, and drying by a hot air dryer, in order to for the solvent to be removed and the dispersing element to be dried, as a result of which a toner base can be obtained.

After this, preferably, the toner base may be subjected to an aging process. The toner base may be aged at preferably 30° C. to 55° C. (more preferably at 40° C. to 50° C.) for 5 hours to 36 hours (more preferably, for 10 hours to 24 hours).

In the case where the dispersing element has a wide particle size distribution during the emulsifying and dispersing, and the resulting particles are washed and dried with keeping such particle size distribution, the particle size distribution can be adjusted to the intended particle size distribution by classification.

As the classification operation performed in the liquid, fine particles can be removed by means of cyclone, a decanter, or centrifugal separator. Of course, the classification may be performed after attaining the particles as powder as a result of the drying. It is however more preferred that the classification be performed in the liquid in terms of the efficiency. The collected unnecessary fine particles or coarse particles are returned to the kneading process to use them for the formation of particles. In this recycling operation, the fine particles or coarse particles may be in the wet state.

The used dispersant is preferably removed from the dispersion liquid as much as possible, and the removal of the dispersant is preferably performed at the same time as the operation of the classification.

By mixing the obtained and dried toner powder with other particles such as releasing agent particles, charge controlling particles, fluidizer particles, and colorant particles, or applying a mechanical impact to the powder mixture, the aforementioned other particles are fixed and fused on surfaces of the obtained composite particles, to thereby prevent the other particles from detaching from the surfaces of the composite particles.

A specific method for mixing or applying the impact include a method for applying impulse force to a mixture by a blade rotating at high speed, and a method for adding a mixture into a high-speed air flow and the speed of the flow is accelerated to thereby make the particles crash onto other particles, or make the composite particles crash onto an appropriate impact board. Examples of the device for use include ANGMILL (manufactured by Hosokawa Micron Corporation), an apparatus made by modifying I-TYPE MILL (manufactured by Nippon Pneumatic Mfg. Co., Ltd.) to reduce the pulverizing air pressure, a hybridization system (manufactured by Nara Machinery Co., Ltd.), a kryptron system (manufactured by Kawasaki Heavy Industries, Ltd.) and an automatic mortar.

Finally, external additives such as inorganic particules and the toner are mixed by a HENSCHEL MIXER or the like, coarse particles are removed by ultrasonic sieving, and finally toner is thereby obtained.

(Two-Component Developer)

A two-component developer of the present invention contains at least a toner and a carrier (magnetic carrier) having a magnetic property. This toner is the toner of the present invention.

When the toner of the present invention is used in a two-component developer, it may be mixed with a magnetic carrier. The ratio between the content of the carrier and the content of the toner in the developer is preferably from 1 part by mass to 10 parts by mass of toner relative to 100 parts by mass of carrier.

<Carrier for Two-Component Developer>

As for the magnetic carrier, conventional carriers, such as iron powder, ferrite powder, magnetite powder, and magnetic resin carrier having the particle size of about 20 μm to 200 μm, can be used. Examples of coating materials for the carrier include: an amino resin such as a urea-formaldehyde resin, a melamine resin, a benzoguanamine resin, a urea resin, a polyamide resin; an epoxy resin. Other examples include polyvinyl and polyvinylidene resins; such as an acrylic resin, polymethyl methacrylate resin, polyacrylonitrile resin, polyvinyl acetate resin, polyvinyl alcohol resin, and polyvinyl butyral resin; a polystyrene resin such as polystyrene resin, and a styrene-acryl copolymer resin; a halogenated olefin resin such as polyvinyl chloride; a polyester resin such as polyethylene terephthalate resin, and polybutylene terephthalate resin; and others such as a polycarbonate resin, a polyethylene resin, polyvinyl fluoride resin, polyvinylidene fluoride resin, polytrifluoroethylene resin, polyhexafluoropropylene resin, a copolymer of vinylidene fluoride and an acrylic monomer, a copolymer of vinylidene fluoride and vinyl fluoride, and a fluoroterpolymer such as a terpolymer of tetrafluoroethylene, vinylidene fluoride, and a non-fluoromonomer, and a silicone resin. The coating resin may contain electric conductive powder, if necessary. Examples of the electric conductive power include metal powder, carbon black, titanium oxide, tin oxide, and zinc oxide), if necessary. The electric conductive powder preferably has the average particle size of 1 μm or smaller. When the average particle size of the electric conductive powder is larger than 1 μm, it is difficult to control electric resistance.

The toner of the present invention can also be used as a one-component magnetic toner containing no carrier, or as a non-magnetic toner.

With a two-component developer containing the toner of the present invention and a carrier having at least a magnetic property, it is possible to provide a two-component developer which can appropriately ensure toner flowability even under high-temperature, high-humidity conditions, with which development and transfer can be appropriately performed with less contamination to the developing member, and which is highly stable (reliable) in terms of environmental endurance.

(Process Cartridge)

A process cartridge of the present invention includes: a latent image carrier; and a developing unit containing at least a toner. The process cartridge supports the latent image carrier and the developing unit integrally, and is attachable to and detachable from an image forming apparatus body. The toner is the toner of the present invention.

According to the present invention, it is possible to provide a process cartridge which includes: a latent image carrier; and a developing unit containing at least a toner, supports the latent image carrier and the developing unit integrally, and is attachable to and detachable from an image forming apparatus body, wherein the toner is the toner of the present invention.

Figure 2:
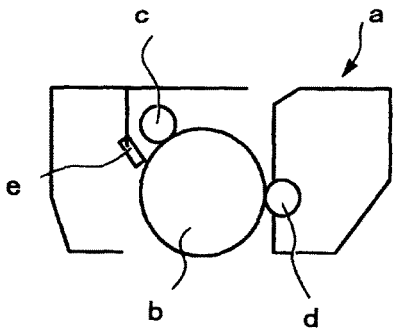
FIG. 2 is a schematic structural diagram showing an example of an embodiment of a process cartridge of the present invention.

FIG. 2 is a schematic diagram showing the configuration of an image forming apparatus including the process cartridge of the present invention. In FIG. 2, "a" indicates a whole process cartridge, "b" indicates a photoconductor, "c" indicates a charging unit, "d" indicates a developing unit, and "e" indicates a cleaning unit.

In the present invention, of the aforementioned constituting members such as the photoconductor b, the charging unit c, the developing unit d, and the cleaning unit e, at least the photoconductor b and the developing unit d are coupled integrally as a process cartridge, and this process cartridge is configured attachable to and detachable from an image forming apparatus such as a copier and a printer.

(Image Forming Apparatus and Image Forming Method)

An image forming apparatus of the present invention includes: a developing unit containing at least a toner and configured to perform development with the toner to form a visible image; and a fixing unit configured to fix the visible image on a recording medium by heat and pressure, and if necessary, further includes other units such as a latent image carrier, a charging unit, an exposure unit, a transfer unit, a cleaning unit, a neutralizing unit, a recycling unit, and a control unit.

The toner is the toner of the present invention.

An image forming method of the present invention includes: performing development with a toner to form a visible image; and fixing the visible image on a recording medium by heat and pressure, and if necessary, further includes other steps such as charging, exposing, transferring, cleaning, neutralizing, recycling, and controlling.

The toner is the toner of the present invention.

The image forming method used in the present invention can be preferably performed by the image forming apparatus of the present invention. The step of performing development can be preferably performed by the developing unit, the step of fixing can be preferably performed by the developing unit, and the other steps can be preferably performed by the other units.

<Developing Step and Developing Unit>

With no particular restrictions, any conventional developing device can be selected as the developing unit, as long as it employs a tandem developing system in which developing sub-units for at least four or more different developing colors are arranged in series, and has a system speed of 200 mm/sec to 3,000 mm/sec. For example, a developing device which houses the toner and has a developing member capable of feeding the toner to an electrostatic latent image by contacting the image or contactlessly can be preferably selected.

The developing step is performed by a tandem developing system in which developing sub-units for at least four or more different developing colors are arranged in series. The system speed is from 200 mm/sec to 3,000 mm/sec. The developing step can be preferably performed by the developing unit.

<Fixing Step and Fixing Unit>

With no particular restrictions, any conventional fixing device can be selected as the fixing unit, as long as it has has a fixing medium with a surface pressure of 10 N/cm$^2$ to 3,000 N/cm$^2$, and has a fixing nip time of 30 msec to 400 msec. For example, a fixing device that includes a fixing member and a heat source for heating the fixing member can be preferably selected.

In the fixing step, the surface pressure of the fixing medium is from 10 N/cm$^2$ to 3,000 N/cm$^2$, and the fixing nip time is from 30 msec to 400 msec. The fixing step can be preferably performed by the fixing unit.

In the image forming apparatus including: a developing unit containing the toner of the present invention; and a fixing unit configured to fix a visible image on a recording medium by heat and pressure, the developing unit employs a tandem developing system in which developing sub-units for at least four or more different developing colors are arranged in series, and has a system speed of 200 mm/sec to 3,000 mm/sec, and the fixing unit has a fixing medium with a surface pressure of 10 N/cm$^2$ to 3,000 N/cm$^2$, and has a fixing nip time of 30 msec to 400 msec. This makes it possible to provide a color image forming apparatus that can appropriately ensure toner flowability even in a region where the system speed is high, can perform development, transfer, and fixing with less contamination to the developing member, has fixing characteristics which can appropriately control deformation of the toner and melting fixation of the toner to a fixing medium (paper, etc.) under a high pressure at the same time as preventing hot offset, can control to a heat quantity suitable for fixation of the toner by appropriately setting the fixing nip time, and can ensure an adequate image quality with low power consumption.

It is also possible to provide an image forming method using the image forming apparatus.

[System Linear Velocity]

In the present invention, a system linear velocity was measured as follows. With the longitudinal direction of sheets of paper set as the direction along which they would be passed through the image forming apparatus, a hundred A4-size sheets of paper each having a length of 297 mm in the passing direction were output from the apparatus serially. When it was assumed that the time taken from the start till the end was A secs and the system speed was B, the system speed was calculated according to the formula shown below.

$$B(\text{mm/sec})=100 \text{ sheets of paper}\times 297 \text{ mm}\div A \text{ secs}$$

[Fixing Surface Pressure]

In the present invention, the fixing surface pressure, which is a surface pressure to press a recording medium, can be measured with a pressure distribution measuring instrument PINCH (manufactured by NITTA Corporation).

[Fixing Nip Time]

A fixing nip time was calculated based on measurements of the linear velocity and a fixing nip width.

Figure 3:
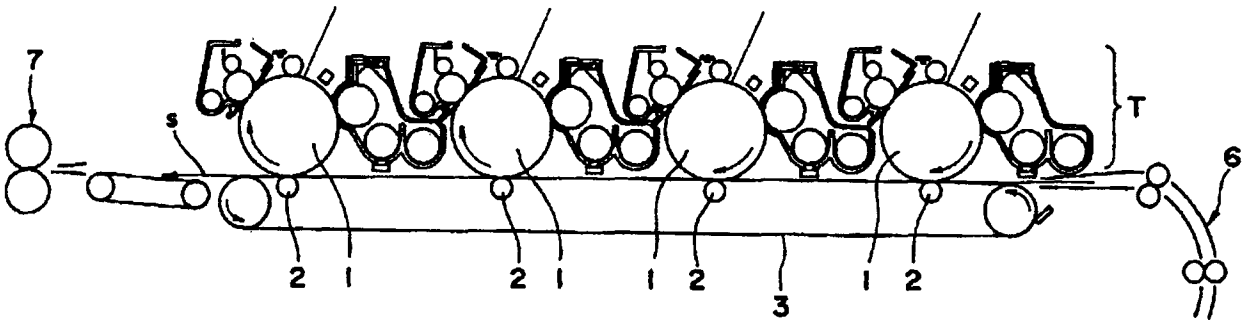
FIG. 3 is a schematic structural diagram showing an example of an embodiment of an image forming apparatus of the present invention.
Figure 4:
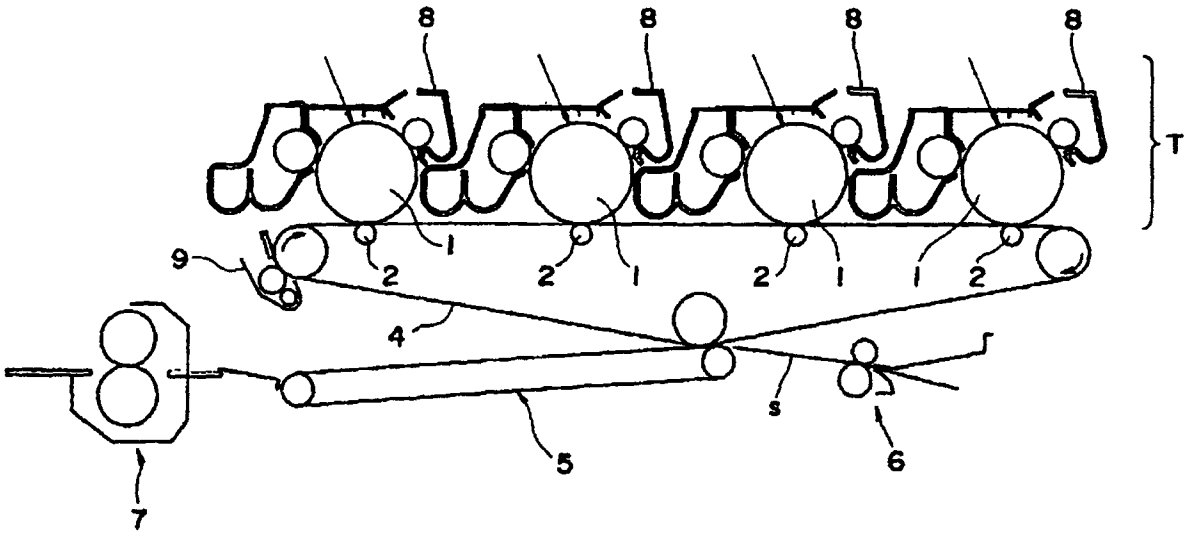
FIG. 4 is a schematic structural diagram showing an example of an embodiment of an image forming apparatus of the present invention.

One example of an embodiment of a tandem color image forming apparatus will be explained. Tandem electrophotographic apparatuses include a direct transfer type that by a transfer device 2, transfers images on the respective photoconductors 1 sequentially to a sheet s conveyed by a sheet conveying belt 3 as shown in FIG. 3, and an indirect transfer type that by a first transfer device 2, once transfers images on the respective photoconductors 1 sequentially to an intermediate transfer member 4, and then by a second transfer device 5, transfers the images on the intermediate transfer member 4 to a sheet s simultaneously as shown in FIG. 4. The transfer device 5 is a transfer conveyor belt, but there is also a roller type transfer device.

In comparison between a direct transfertype and an indirect transfer type, the former has a drawback that its size is large in the sheet conveying direction because a sheet feeding device 6 must be arranged on the upstream side of a tandem image forming apparatus T in which the photoconductors 1 are arranged, and a fixing device 7 must be arranged on the downstream side thereof.

As compared, the second transfer device of the latter can be arranged relatively freely. The sheet feeding device 6 and the fixing device 7 can be arranged overlapping the tandem image forming apparatus T, allowing a smaller apparatus size.

In order to prevent the former from becoming large in the sheet conveying direction, the fixing device 7 should be arranged in proximity to the tandem image forming apparatus T. This hinders the fixing device 7 from being arranged with a margin sufficient for the sheet s to drape, bringing about a drawback that the upstream image forming operation is interrupted by the fixing device 7 due to the impact when the leading end of the sheet s goes into the fixing device 7 (which is more remarkable with a thick sheet) and the difference between the sheet conveying speed when the sheet is passed through the fixing device 7 and the sheet conveying speed when the sheet is conveyed by the transfer conveyor belt.

As compared, the fixing device 7 of the latter can be arranged with a margin sufficient for the sheet s to drape, which can ensure that the image forming operation is barely interrupted by the fixing device 7.

With these facts, tandem electrophotographic apparatuses of, particularly an indirect transfer type have been attracting attention recently.

Color electrophotographic apparatuses of this type have removed any transfer residue toner remained on the photoconductors 1 after the first transfer by a photoconductor cleaning device 8 as shown in FIG. 4 to celan the surface of the photoconductors 1 and to be prepared for the next image formation. Furthermore, these apparatuses have removed any transfer residue toner remained on the intermediate transfer member 4 after the second transfer by an intermediate transfer member cleaning device 9 to clean the surface of the intermediate transfer member 4 and to be prepared for the next image formation.

An embodiment of the present invention will be explained below with reference to the drawings.

Figure 5:
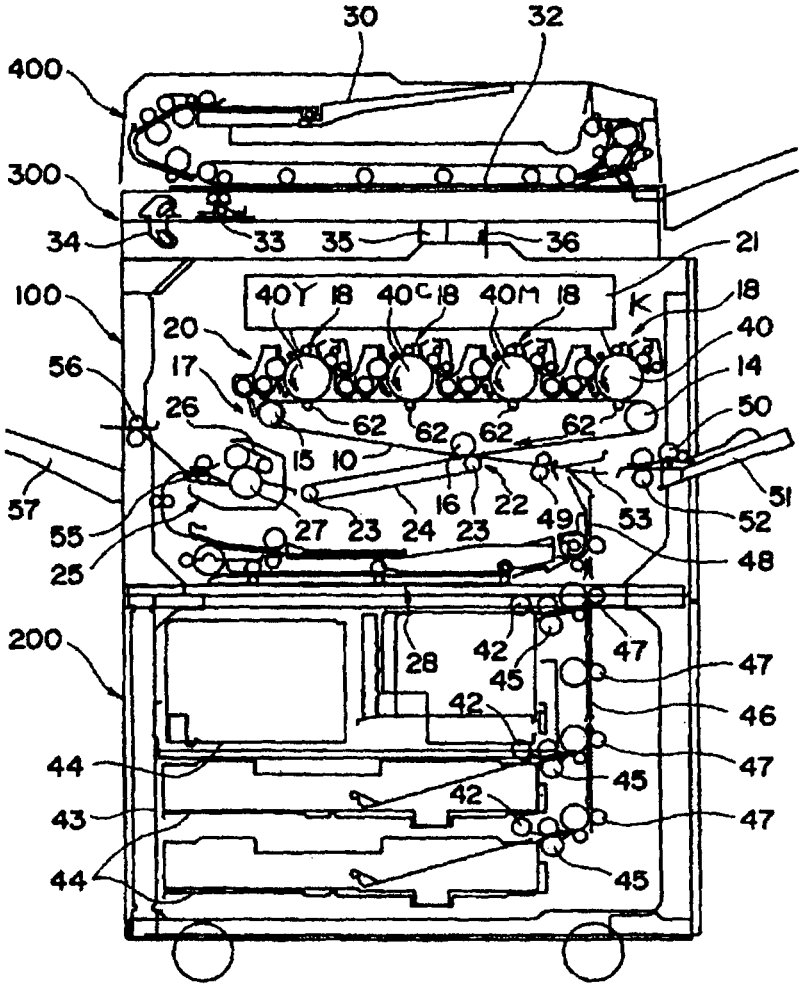
FIG. 5 is a schematic structural diagram showing an example of an embodiment of an image forming apparatus of the present invention.

FIG. 5 shows one embodiment of the present invention, which is a tandem indirect transfer type electrophotographic apparatus. In the drawing, the reference sign 100 denotes a copying machine body, the reference sign 200 denotes a sheet feeding table on which the copying machine body is placed, the reference sign 300 denotes a scanner mounted above the copying machine body 100, and the reference sign 400 denotes an automatic document feeder (ADF) mounted above the scanner. The copier machine body 100 is provided with an endless-belt-like intermediate transfer member 10 in the center thereof.

As shown in FIG. 5, the intermediate transfer member 10 is hung over three, in the shown example, support rollers 14, 15, and 16 so as to be conveyable rotatably in the clockwise direction of the drawing.

In the shown example, an intermediate transfer member cleaning device 17 for removing any residual toner to remain on the intermediate transfer member 10 after image transfer is provided on the left-hand side of the second support roller 15 among the three.

Above the intermediate transfer member 10 tensed between the first support roller 14 and second support roller 15 among the three, four image forming units 18 for yellow, cyan, magenta, and black are arranged side by side in the direction in which the intermediate transfer member is conveyed, to thereby constitute a tandem image forming device 20.

An exposure device 21 is further provided above the tandem image forming device 20 as shown in FIG. 5. On the other hand, a second transfer device 22 is provided on a side of the intermediate transfer member 10 opposite to the tandem image forming device 20. The second transfer device 22 is constituted by a second transfer belt 24, which is an endless belt hung between two, in the shown example, rollers 23, and is disposed to be pressed against the third roller 16 via the intermediate transfer member 10 to transfer the images on the intermediate transfer member 10 to the sheet.

A fixing device 25 for fixing the transferred images on the sheet is provided on a side of the second transfer device 22. The fixing device 25 is constituted by a fixing belt 26, which is an endless belt, and a pressing roller 27 pressed against the fixing belt.

The second transfer device 22 described above also includes a sheet conveying function for conveying the sheet having undergone the image transfer to this fixing device 25. Of course, the second transfer device 22 may alternatively be a transfer roller or a contactless charger. In such a case, it is harder to have this sheet conveying function provided additionally.

In the shown example, a sheet overturning device 28 for overturning the sheet to allow for both-side image recordation is provided under these second transfer device 22 and fixing device 25 in parallel with the tandem image forming device 20.

For the use of this color electrophotographic apparatus for copying, a document is set on a document table 30 of the automatic document feeder 400. Alternatively, the automatic document feeder 400 is opened to set the document on the contact glass 32 of the scanner 300, and then the automatic document feeder 400 is closed to fix the document.

Then, upon a push of a start switch not shown, after the document is conveyed and moved onto the contact glass 32 when the document is set on the automatic document feeder 400, whereas immediately after the push of the start switch when the document is set on the contact glass 32, the scanner 300 is started, and a first traveling member 33 and a second traveling member 34 are started to run. The first traveling member 33 emits light from a light source and reflects the light having reflected from the document surface further to the second traveling member 34, such that the light is reflected on a mirror of the second traveling member 34 to be incident through an image forming lens 35 into a reading sensor 36, which thereby reads the content of the document.

Further, upon the push of the start switch not shown, a driving motor not shown rotatably drives one of the support rollers 14, 15, and 16 to induce following rotations of the other two support rollers to thereby convey the intermediate transfer member 10 rotatably. Simultaneously, the respective image forming units 18 rotate their own photoconductors 40 to form single-color images of black, yellow, magenta, and cyan on the photoconductors 40 respectively. Then, as the intermediate transfer member 10 is conveyed, the image forming units 18 sequentially transfer these single-color images onto the intermediate transfer member 10 to form a composite color image thereon.

Meanwhile, upon the push of the start switch not shown, one of sheet feeding rollers 42 of the sheet feeding table 200 is selectively rotated to bring sheets forward from one of sheet feeding cassettes 44 set over multi-stages in a paper bank 43, and to feed them sheet by sheet separately by a separating roller 45 into a sheet feeding path 46. The sheet is conveyed by a conveying roller 47 to be guided to a sheet feeding path 48 provided in the copying machine body 100, and then stopped when it hits on a registration roller 49.

Alternatively, a sheet feeding roller 50 is rotated to bring forward the sheets on a manual feeding tray 51 and to feed them sheet by sheet separately by a separating roller 52 into a manual sheet feeding path 53. Likewise, the sheet is stopped when it hits on the registration roller 49.

Then, the registration roller 49 is rotated synchronously with the timing of the composite color image on the intermediate transfer member 10 to deliver the sheet to between the intermediate transfer member 10 and the second transfer device 22. The second transfer device 22 transfers and records the color image on the sheet.

The sheet having undergone the image transfer is conveyed by the second transfer device 22 to be delivered to the fixing device 25, which applies heat and pressure to fix the transferred image. After this, a switching claw 55 is switched to allow the sheet to be discharged by a discharging roller 56 and stacked on a sheet discharging tray 57. Alternatively, the switching claw 55 is switched to allow the sheet to be fed to the sheet overturning device 28, overturned, and guided again to the transfer position, such that an image is recorded also on the back side of the sheet and then the sheet is discharged by the discharging roller 56 onto the sheet discharging tray 57.

Meanwhile, the intermediate transfer member cleaning device 17 removes any residual toner remained on the intermediate transfer member 10 after the image transfer, to prepare the intermediate transfer member 10 after the image transfer for the next image formation by the tandem image forming device 20.

Generally, the registration roller 49 is often used with earthing. However, a bias may be applied to it to remove sheet scraps of the sheet.

Figure 6:
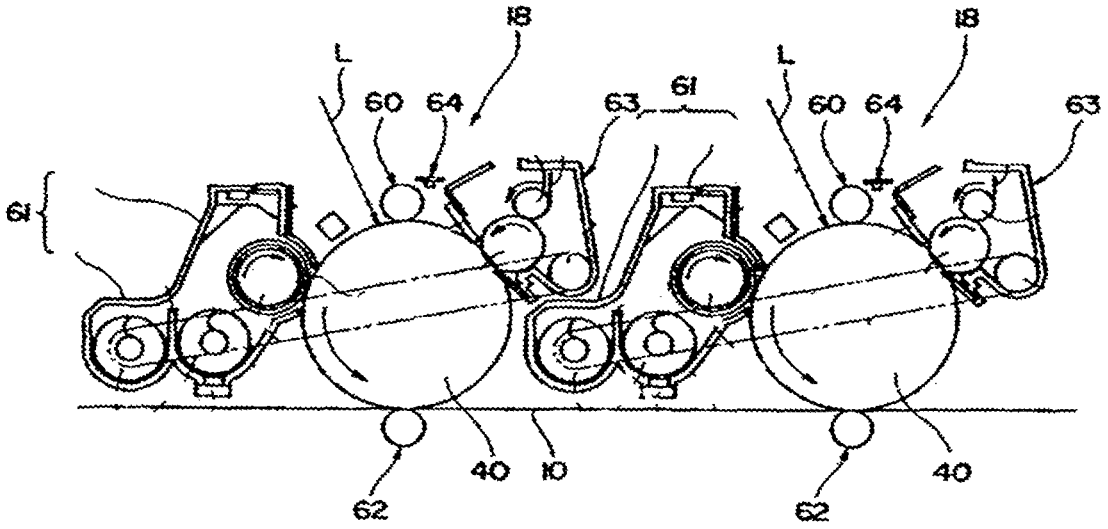
FIG. 6 is a schematic structural diagram showing an example of an embodiment of an image forming apparatus of the present invention.

In the tandem image forming device 20 described above, each image forming unit 18 is, to be specific, constituted by the drum-like photoconductor 40, and a charging device 60, a developing device 61, a first transfer device 62, a photoconductor cleaning device 63, a neutralizing device 64, etc. which are provided around the photoconductor, as shown in FIG. 6, for example.

EXAMPLES

The present invention will be further explained below based on Examples. The present invention is not limited to these Examples. In the following explanation, unless otherwise indicated, part indicates a part by mass, and percentage indicates % by mass.

(Evaluator A)

As an evaluator, IMAGIO MP C6000 was used with modifications to its fixing device mainly. The linear velocity was adjusted to 350 mm/sec. The fixing unit of the fixing device was adjusted to a fixing surface pressure of 40 N/cm$^2$, and a fixing nip time of 40 msec. The surface of the fixing medium was coated with a tetrafluoroethylene-perfluoroalkylvinylether copolymer resin (PFA), shaped, and surface-conditioned, before use. The heating temperature of the fixing unit was set to 100° C.

(Evaluator B)

As an evaluator, IMAGIO MP C6000 was used with modifications to its fixing device mainly. The developing unit, the transfer unit, the cleaning unit, and the conveying unit were all changed or adjusted so as to obtain a linear velocity of 2,200 mm/sec. The fixing unit of the fixing device was adjusted to a fixing surface pressure of 110 N/cm$^2$, and a fixing nip time of 130 msec. The surface of the fixing medium was coated with a tetrafluoroethylene-perfluoroalkylvinylether copolymer resin (PFA), shaped, and surface-conditioned, before use. The heating temperature of the fixing unit was set to 110° C.

(Evaluation of Two-Component Developer)

For image evaluation with a two-component developer, the developer was prepared by coating a ferrite carrier having an average particle size of 35 μm with a silicone resin to an average thickness of 0.5 μm, and uniformly mixing 100 parts of the carrier and 7 parts of the toner of each color with a turbula mixer that stirred and electrically charged them by the container's tumbling motion (Preparation of Carrier)

| Core | |
|---|---|
| Mn ferrite particles (weight-average particle size: 35 μm) | 5,000 parts |
| Coating materials | |
| toluene | 450 parts |
| Silicone resin SR2400 (Dow Corning Toray Co., Ltd., non-volatile component: 50%) | 450 parts |
| amino silane SH6020 (Dow Corning Tray Co., Ltd) | 10 parts |
| carbon black | 10 parts |

The coating materials listed above were dispersed for 10 minutes by a stirrer to prepare a coating liquid. This coating liquid and the core were subjected to a coating device equipped with a rotary bottom plate disk and a stirring blade in a fluid bed for performing coating by forming a circulating current, to thereby coat the core with the coating liquid. The obtained coated material was burned in an electric furnace at 250° C. for 2 hours, to thereby obtain the carrier.

Example 1

<Synthesis of Fine Resin Particle Emulsion>

A reaction vessel equipped with a stirring bar and a thermometer was charged with water (683 parts), a sodium salt of sulfuric acid ester of methacrylic acid-ethylene oxide adduct (ELEMINOL RS-30, manufactured by Sanyo Chemical Industries, Ltd.) (11 parts), polylactate (10 parts), styrene (60 parts), methacrylic acid (100 parts), butyl acrylate (70 parts), and ammonium persulfate (1 part), and the resulting mixture was stirred for 30 minutes at 3,800 rpm, to thereby obtain a white emulsion. The white emulsion was heated until the internal temperature became 75° C., and was allowed to react for 4 hours. To this, a 1% ammonium persulfate aqueous solution (30 parts) was added, followed by aging for 6 hours at 75° C., to thereby obtain Particle Dispersion Liquid 1 (an aqueous dispersion liquid of a vinyl resin (a copolymer of styrene/methacrylic acid/butyl acrylate/sodium salt of sulfuric acid ester of methacrylic acid ethylene oxide adduct)). The volume average particle size of Particle Dispersion Liquid 1 was measured by LA-920, and it was 280 nm. Part of Particle Dispersion Liquid 1 was dried to separate the resin component. The glass transition point Tg of the resin component was 59° C., and the weight-average molecular weight thereof was 60,000.

<Preparation of Aqueous Phase>

Water (990 parts), Particle Dispersion Liquid 1 (83 parts), a 48.3% aqueous solution of sodium dodecyldiphenyl ether disulfonate (ELEMINOL MON-7, product of Sanyo Chemical Industries Ltd.) (37 parts), and ethyl acetate (90 parts) were mixed together and stirred to obtain an opaque white liquid, which was used as Aqueous Phase 1.

<Synthesis of Non-Crystalline Low-Molecular Polyester>

A reaction vessel equipped with a cooling tube, a stirrer, and a nitrogen introducing tube was charged with an adduct of 2 mol of bisphenol A propyleneoxide (430 parts), an adduct of 3 mol of bisphenol A propyleneoxide (300 parts), terephthalic acid (247 parts), isophthalic acid (75 parts), maleic anhydride (10 parts), and titanium dihydroxy bis (triethanol aminate) as a condensation catalyst (2 parts), and the resulting mixture was reacted for 8 hours at 220° C. while distilling away water to be produced under a nitrogen stream. Then, the mixture was reacted under a reduced pressure reduced by 5 mmHg to 20 mmHg, taken out from the reaction vessel when the acid value became 7, cooled to room temperature, and pulverized, to thereby obtain Non-Crystalline Low-Molecular Polyester 1. The number average molecular weight thereof was 5,110, the weight-average molecular weight thereof was 24,300, the glass transition point Tg thereof was 58° C., and the acid value thereof was 8 mgKOH/g.

<Synthesis of Non-Crystalline Intermediate Polyester>

A reaction vessel equipped with a cooling tube, a stirrer, and a nitrogen introducing tube was charged with an adduct of 2 mol of bisphenol A ethylene oxide (682 parts), an adduct of 2 mol of bisphenol A propylene oxide (81 parts), terephthalic acid (283 parts), trimellitic anhydride (22 parts), and dibutyltinoxide (2 parts), and the resulting mixture was reacted at normal pressures at 230° C. for 7 hours, and then reacted at a reduced pressure reduced by 10 mmHg to 15 mmHg for 5 hours, to thereby obtain Intermediate Polyester 1. The number average molecular weight of Intermediate Polyester 1 was 2,200, the weight-average molecular weight thereof was 9,700, the glass transition point thereof was 54° C., the acid value thereof was 0.5, and the hydroxyl value thereof was 52.

Next, a reaction vessel equipped with a cooling tube, a stirrer, and a nitrogen introducing tube was charged with Intermediate Polyester 1 (410 parts), isophorone diisocyanate (89 parts), and ethyl acetate (500 parts), and the resulting mixture was reacted at 100° C. for 5 hours, to thereby obtain Prepolymer 1. The content of free isocyanate in Prepolymer 1 was 1.53% by mass.

<Synthesis of Ketimine>

A reaction vessel equipped with a stirring bar and a thermometer was charged with isophorone diamine (170 parts) and methyl ethyl ketone (75 parts), and the resulting mixture was allowed to react for 4 hours at 50° C., to thereby obtain Ketimine Compound 1. Ketimine Compound 1 had the amine value of 417 mgKOH/g.

<Synthesis of Master Batch>

Crystalline Polyester 1 described below (100 parts), a cyan pigment (C.I. Pigment blue 15:3) (100 parts), and ion-exchanged water (100 parts) were mixed by a HENSCHEL MIXER (manufactured by Nippon Coke & Engineering. Co., Ltd.), and kneaded by an open-roll kneader (KNEADEX manufactured by Nippon Coke & Engineering. Co., Ltd.). After kneaded for 1 hour at 90° C., the mixture was milled, cooled, and pulverized by a pulverizer, to thereby obtain Master Batch 1.

<Synthesis of Crystalline Polyester Resin>

A reaction vessel equipped with a cooling tube, a stirrer, and a nitrogen introducing tube was charged with 1,6-hexanediol (1,200 parts), decanedioic acid (1,200 parts), and dibutyltinoxide as a catalyst (0.4 part), the air in the vessel was purged by a nitrogen gas under a depressurizing operation to make an inert atmosphere, and the mixture was mechanically stirred at 180 rpm for 5 hours. After this, under a reduced pressure, the mixture was gradually warmed until it became 210° C., stirred for 1.5 hours, air-cooled when it became viscous, and the reaction was terminated, to thereby obtain Crystalline Polyester 1. The number average molecular weight of Crystalline Polyester 1 was 3,400, the weight-average molecular weight thereof was 15,000, and the melting point thereof was 64° C.

<Preparation of Oil Phase>

A vessel equipped with a stirring bar and a thermometer was charged with Non-Crystalline Low-Molecular Polyester 1 (50 parts), a paraffin WAX (melting point 90° C.) (120 parts), Crystalline Polyester 1 (528 parts), and ethyl acetate (947 parts), and the resulting mixture was warmed to 80° C. while being stirred, retained at 80° C. for 5 hours, and then cooled to 30° C. in 1 hour. Then, the vessel was charged with Master Batch 1 (100 parts) and ethyl acetate (100 parts), and the materials were mixed for 1 hour, to thereby obtain Material-Dissolved Liquid 1.

Material-Dissolved Liquid 1 (1,324 parts) was changed to another vessel, into which a colorant and a WAX were dispersed by a beads mill (ULTRA VISCOMILL manufactured by IMEX Co., Ltd.) on the conditions of a solution sending speed of 1 kg/hr, a disk circumferential velocity of 6 m/sec, the vessel being filled with 0.5 mm zirconia beads to 80% by volume, and 3 passes. To which, a 65% ethyl acetate solution of Non-Crystalline Low-Molecular Polyester 1 (1,324 parts) was added, and the resulting mixture was subjected to the beads mill on the above conditions but for 2 passes, to thereby obtain Pigment/WAX Dispersion Liquid 1. The solid content concentration of Pigment/WAX Dispersion Liquid 1 (130° C., 30 minutes) was 50%.

<Emulsification and Solvent Removal>

A vessel was charged with Pigment/WAX Dispersion Liquid 1 (749 parts), Prepolymer 1 (120 parts), and Ketimine Compound 1 (3.5 parts), and the materials were mixed by a TK Homomixer (manufactured by Primix Corporation) at 5,000 rpm for 5 minutes. After this, Aqueous Phase 1 (1,200 parts) was added to the vessel, and the materials were mixed by the TK Homomixer at 10,000 rpm for 1.5 hours, to thereby obtain Emulsified Slurry 1.

Emulsified Slurry 1 was fed into a vessel equipped with a stirrer and a thermometer, subjected to solvent removal for 8 hours at 30° C., and then aged for 72 hours at 40° C., to thereby obtain Dispersed Slurry 1.

<Washing and Drying>

After subjecting Dispersion Slurry 1 (100 parts) to filtration under a reduced pressure, the resultant was subjected twice to a series of treatments (1) to (4) described below, to thereby produce Filtration Cake 1:

(1): ion-exchanged water (100 parts) was added to a filtration cake, followed by mixing with TK Homomixer (at 12,000 rpm for 10 minutes) and then filtration;

(2): a 10% aqueous sodium hydroxide solution (100 parts) was added to the filtration cake obtained in (1), followed by mixing with TK Homomixer (at 12,000 rpm for 30 minutes) and then filtration under reduced pressure;

(3): 10% hydrochloric acid (100 parts) was added to the filtration cake obtained in (2), followed by mixing with TK Homomixer (at 12,000 rpm for 10 minutes) and then filtration; and (4): ion-exchanged water (300 parts) was added to the filtration cake obtained in (3), followed by mixing with TK Homomixer (at 12,000 rpm for 10 minutes) and then filtration.

Filtration Cake 1 was dried with an air-circulating drier at 45° C. for 48 hours, and then was caused to pass through a sieve with a mesh size of 75 μm, to thereby prepare Toner Base Particles 1.

After this, Toner Base Particles 1 (100 parts) and hydrophobized silica with a particle size of 13 nm (1 part) were mixed with a HENSCHEL MIXER, to thereby obtain toner. The physical properties of the obtained toner are shown in Table 1, and the results of evaluation of the toner by the evaluator A are shown in Table 2.

Example 2

A toner was obtained in the same manner as Example 1, except that Particle Dispersion Liquid 1 used in Example 1 was changed to Particle Dispersion Liquid 2 described below, and Material-Dissolved Liquid 1 used for the oil phase was changed to Material-Dissolved Liquid 2 described below. The physical properties of the obtained toner are shown in Table 1, and the results of evaluation of the toner by the evaluator A are shown in Table 2.

<Synthesis of Fine Resin Particle Emulsion>

A reaction vessel equipped with a stirring bar and a thermometer was charged with water (683 parts), a sodium salt of sulfuric acid ester of methacrylic acid-ethylene oxide adduct (ELEMINOL RS-30, manufactured by Sanyo Chemical Industries, Ltd.) (11 parts), polylactate (10 parts), styrene (70 parts), methacrylic acid (90 parts), butyl acrylate (60 parts), and ammonium persulfate (1 part), and the resulting mixture was stirred for 30 minutes at 3,800 rpm, to thereby obtain a white emulsion. The white emulsion was heated until the internal temperature became 75° C., and was allowed to react for 3 hours. To this, a 1% ammonium persulfate aqueous solution (30 parts) was added, followed by aging for 6 hours at 75° C., to thereby obtain Particle Dispersion Liquid 2 (an aqueous dispersion liquid of a vinyl resin (a copolymer of styrene/methacrylic acid/butyl acrylate/sodium salt of sulfuric acid ester of methacrylic acid ethylene oxide adduct)). The volume average particle size of Particle Dispersion Liquid 2 was measured by LA-920, and it was 153 nm. Part of Particle Dispersion Liquid 2 was dried to separate the resin component. The glass transition point Tg of the resin component was 59° C., and the weight-average molecular weight thereof was 150,000.

<Preparation of Oil Phase>

A vessel equipped with a stirring bar and a thermometer was charged with Non-Crystalline Low-Molecular Polyester 1 (5 parts), a paraffin WAX (melting point 90° C.) (120 parts), Crystalline Polyester 1 (573 parts), and ethyl acetate (947 parts), and the resulting mixture was warmed to 80° C. while being stirred, retained at 80° C. for 5 hours, and then cooled to 30° C. in 1 hour. Then, the vessel was charged with Master Batch 1 (500 parts) and ethyl acetate (500 parts), and the materials were mixed for 1 hour, to thereby obtain Material-Dissolved Liquid 2.

Example 3

A toner was obtained in the same manner as Example 1, except that Particle Dispersion Liquid 1 used in Example 1 was changed to Particle Dispersion Liquid 3 described below, and Material-Dissolved Liquid 1 used for the oil phase was changed to Material-Dissolved Liquid 2 described above. The physical properties of the obtained toner are shown in Table 1, and the results of evaluation of the toner by the evaluator A are shown in Table 2.

<Synthesis of Fine Resin Particle Emulsion>

A reaction vessel equipped with a stirring bar and a thermometer was charged with water (683 parts), a sodium salt of sulfuric acid ester of methacrylic acid-ethylene oxide adduct (ELEMINOL RS-30, manufactured by Sanyo Chemical Industries, Ltd.) (11 parts), polylactate (10 parts), styrene (60 parts), methacrylic acid (100 parts), butyl acrylate (70 parts), and ammonium persulfate (1 part), and the resulting mixture was stirred for 20 minutes at 2,000 rpm, to thereby obtain a white emulsion. The white emulsion was heated until the internal temperature became 75° C., and was allowed to react for 3 hours. To this, a 1% ammonium persulfate aqueous solution (30 parts) was added, followed by aging for 12 hours at 65° C., to thereby obtain Particle Dispersion Liquid 3 (an aqueous dispersion liquid of a vinyl resin (a copolymer of styrene/methacrylic acid/butyl acrylate/sodium salt of sulfuric acid ester of methacrylic acid ethylene oxide adduct)). The volume average particle size of Particle Dispersion Liquid 3 was measured by LA-920, and it was 640 nm. Part of Particle Dispersion Liquid 3 was dried to separate the resin component. The glass transition point Tg of the resin component was 59° C., and the weight-average molecular weight thereof was 120,000.

Example 4

A toner was obtained in the same manner as Example 1, except that. Particle Dispersion Liquid 1 used in Example 1 was changed to Particle Dispersion Liquid 2 described above, and Material-Dissolved Liquid 1 used for the oil phase was changed to Material-Dissolved Liquid 3 described below. The physical properties of the obtained toner are shown in Table 1, and the results of evaluation of the toner by the evaluator A are shown in Table 2.

<Preparation of Oil Phase>

A vessel equipped with a stirring bar and a thermometer was charged with Non-Crystalline Low-Molecular Polyester 1 (178 parts), a paraffin WAX (melting point 90° C.) (120 parts), Crystalline Polyester 1 (400 parts), and ethyl acetate (947 parts), and the resulting mixture was warmed to 80° C. while being stirred, retained at 80° C. for 5 hours, and then cooled to 30° C. in 1 hour. Then, the vessel was charged with Master Batch 1 (500 parts) and ethyl acetate (500 parts), and the materials were mixed for 1 hour, to thereby obtain Material-Dissolved Liquid 3.

Example 5

A toner was obtained in the same manner as Example 1, except that Particle Dispersion Liquid 1 used in Example 1 was changed to Particle Dispersion Liquid 3 described above, and Material-Dissolved Liquid 1 used for the oil phase was changed to Material-Dissolved Liquid 3 described above. The physical properties of the obtained toner are shown in Table 1, and the results of evaluation of the toner by the evaluator A are shown in Table 2.

Example 6

A toner was obtained in the same manner as Example 1, except that Particle Dispersion Liquid 1 used in Example 1 was changed to Particle Dispersion Liquid 4 described below, and Material-Dissolved Liquid 1 used for the oil phase was changed to Material-Dissolved Liquid 3 described above. The physical properties of the obtained toner are shown in Table 1, and the results of evaluation of the toner by the evaluator A are shown in Table 2.

<Synthesis of Fine Resin Particle Emulsion>

A reaction vessel equipped with a stirring bar and a thermometer was charged with water (683 parts), a sodium salt of sulfuric acid ester of methacrylic acid-ethylene oxide adduct (ELEMINOL RS-30, manufactured by Sanyo Chemical Industries, Ltd.) (11 parts), polylactate (15 parts), styrene (50 parts), methacrylic acid (100 parts), butyl acrylate (75 parts), and ammonium persulfate (1 part), and the resulting mixture was stirred for 20 minutes at 2,000 rpm, to thereby obtain a white emulsion. The white emulsion was heated until the internal temperature became 75° C., and was allowed to react for 3 hours. To this, a 1% ammonium persulfate aqueous solution (30 parts) was added, followed by aging for 12 hours at 65° C., to thereby obtain Particle Dispersion Liquid 4 (an aqueous dispersion liquid of a vinyl resin (a copolymer of styrene/methacrylic acid/butyl acrylate/sodium salt of sulfuric acid ester of methacrylic acid ethylene oxide adduct)). The volume average particle size of Particle Dispersion Liquid 4 was measured by LA-920, and it was 690 nm. Part of Particle Dispersion Liquid 4 was dried to separate the resin component. The glass transition point Tg of the resin component was 62° C., and the weight-average molecular weight thereof was 140,000.

Example 7

The toner of Example 1 was evaluated by the evaluator B. The results of the evaluation are shown in Table 2.

Comparative Example 1

A toner was obtained in the same manner as Example 1, except that Particle Dispersion Liquid 1 used in Example 1 was changed to Particle Dispersion Liquid 5 described below, and Material-Dissolved Liquid 1 used for the oil phase was changed to Material-Dissolved Liquid 4 described below. The physical properties of the obtained toner are shown in Table 1, and the results of evaluation of the toner by the evaluator A are shown in Table 2.

<Preparation of Oil Phase>

A vessel equipped with a stirring bar and a thermometer was charged with Non-Crystalline Low-Molecular Polyester 1 (0 part), a paraffin WAX (melting point 90° C.) (120 parts), Crystalline Polyester 1 (578 parts), and ethyl acetate (947 parts), and the resulting mixture was warmed to 80° C. while being stirred, retained at 80° C. for 5 hours, and then cooled to 30° C. in 1 hour. Then, the vessel was charged with Master Batch 1 (500 parts) and ethyl acetate (500 parts), and the materials were mixed for 1 hour, to thereby obtain Material-Dissolved Liquid 4.

<Synthesis of Fine Resin Particle Emulsion>

A reaction vessel equipped with a stirring bar and a thermometer was charged with water (683 parts), a sodium salt of sulfuric acid ester of methacrylic acid-ethylene oxide adduct (ELEMINOL RS-30, manufactured by Sanyo Chemical Industries, Ltd.) (11 parts), polylactate (10 parts), styrene (30 parts), methacrylic acid (110 parts), butyl acrylate (80 parts), and ammonium persulfate (1 part), and the resulting mixture was stirred for 30 minutes at 3,800 rpm, to thereby obtain a white emulsion. The white emulsion was heated until the internal temperature became 75° C., and was allowed to react for 3 hours. To this, a 1% ammonium persulfate aqueous solution (30 parts) was added, followed by aging for 6 hours at 75° C., to thereby obtain Particle Dispersion Liquid 5 (an aqueous dispersion liquid of a vinyl resin (a copolymer of styrene/methacrylic acid/butyl acrylate/sodium salt of sulfuric acid ester of methacrylic acid ethylene oxide adduct)). The volume average particle size of Particle Dispersion Liquid 5 was measured by LA-920, and it was 92 nm. Part of Particle Dispersion Liquid 5 was dried to separate the resin component. The glass transition point Tg of the resin component was 60° C., and the weight-average molecular weight thereof was 130,000.

Comparative Example 2

A toner was obtained in the same manner as Example 1, except that Particle Dispersion Liquid 1 used in Example 1 was changed to Particle Dispersion Liquid 6 described below, and Material-Dissolved Liquid 1 used for the oil phase was changed to Material-Dissolved Liquid 4 described above. The physical properties of the obtained toner are shown in Table 1, and the results of evaluation of the toner by the evaluator A are shown in Table 2.

<Synthesis of Fine Resin Particle Emulsion>

A reaction vessel equipped with a stirring bar and a thermometer was charged with water (683 parts), a sodium salt of sulfuric acid ester of methacrylic acid-ethylene oxide adduct (ELEMINOL RS-30, manufactured by Sanyo Chemical Industries, Ltd.) (11 parts), polylactate (10 parts), styrene (90 parts), methacrylic acid (70 parts), butyl acrylate (70 parts), and ammonium persulfate (1 part), and the resulting mixture was stirred for 20 minutes at 2,000 rpm, to thereby obtain a white emulsion. The white emulsion was heated until the internal temperature became 75° C., and was allowed to react for 3 hours. To this, a 1% ammonium persulfate aqueous solution (30 parts) was added, followed by aging for 12 hours at 65° C., to thereby obtain Particle Dispersion Liquid 6 (an aqueous dispersion liquid of a vinyl resin (a copolymer of styrene/methacrylic acid/butyl acrylate/sodium salt of sulfuric acid ester of methacrylic acid ethylene oxide adduct)). The volume average particle size of Particle Dispersion Liquid 6 was measured by LA-920, and it was 740 nm. Part of Particle Dispersion Liquid 6 was dried to separate the resin component. The glass transition point Tg of the resin component was 61° C., and the weight-average molecular weight thereof was 140,000.

Comparative Example 3

A toner was obtained in the same manner as Example 1, except that Particle Dispersion Liquid 1 used in Example 1 was changed to Particle Dispersion Liquid 5 described above, and Material-Dissolved Liquid 1 used for the oil phase was changed to Material-Dissolved Liquid 5 described below. The physical properties of the obtained toner are shown in Table 1, and the results of evaluation of the toner by the evaluator A are shown in Table 2.

<Preparation of Oil Phase>

A vessel equipped with a stirring bar and a thermometer was charged with Non-Crystalline Low-Molecular Polyester 1 (378 part), a paraffin WAX (melting point 90° C.) (120 parts), Crystalline Polyester 1 (200 parts), and ethyl acetate (947 parts), and the resulting mixture was warmed to 80° C. while being stirred, retained at 80° C. for 5 hours, and then cooled to 30° C. in 1 hour. Then, the vessel was charged with Master Batch 1 (500 parts) and ethyl acetate (500 parts), and the materials were mixed for 1 hour, to thereby obtain Material-Dissolved Liquid 5.

Comparative Example 4

A toner was obtained in the same manner as Example 1, except that Particle Dispersion Liquid 1 used in Example 1 was changed to Particle Dispersion Liquid 6 described above, and Material-Dissolved Liquid 1 used for the oil phase was changed to Material-Dissolved Liquid 5 described above. The physical properties of the obtained toner are shown in Table 1, and the results of evaluation of the toner by the evaluator A are shown in Table 2.

(Evaluation Items)

1) Low-Temperature Fixability Under Low-Temperature, Low-Humidity Conditions

Under low-temperature, low-humidity conditions having a temperature of 10° C. and a humidity of 15% RH, with the use of the obtained two-component developer and the evaluators, 10,000 charts each having an image occupation rate of 3% were output, and after this, low-temperature fixability was measured by outputting images while changing the temperature of a fixing roll by 5° C. steps from 95° C. RICOH FULL COLOR PPC PAPER TYPE 6200 was used as transfer paper.

The fixing temperature of a single-unit fixing device was changed so as to obtain a printed image having an image concentration of 1.2 when measured by X-Rite 938. Copied images fixed at various temperatures were rubbed 50 times by a clockmeter fitted with an ink eraser, the image concentrations before and after the rubbing were measured, and the fixing rate was calculated according to the following formula.

$$\text{Fixing rate}(\%)=[(\text{image concentration after 50 times of ink eraser rubbing})/(\text{image concentration before rubbing})]\times 100$$

The temperature at which a fixing rate of 70% or higher was achieved was set as a lower limit fixing temperature. The evaluation criteria for the low-temperature fixability are as follows. The results of evaluation are indicated as shown below.

A: Excellent, with the lower limit fixing temperature of from 95° C. to 100° C.

B: Good, with the lower limit fixing temperature of from 105° C. to 110° C.

C: Same as conventional, with the lower limit fixing temperature of from 115° C. to 130° C.

D: Poor, with the lower limit fixing temperature of from 135° C. to 170° C.

2) Flowability Evaluation Under High-Temperature, High-Humidity Conditions

Flowability was measured by a powder tester (PT-N TYPE, manufactured by Hosokawa Micron Corporation) installed under high-temperature, high-humidity conditions (35° C., 80% RH). Specifically, flowability measurement was performed by passing 2.0 g of toner through sieves (plain weave wire meshes, JIS Z 8801-1 Standard) with mesh sizes of 150 μm, 75 μm, and 45 μm, measuring the amount of toner remained on each sieve, and calculating the formula shown below.

$$\text{Flowability}(\%)=(A+0.6\times B+0.2\times C)/2.0\times 100$$

A: The amount of toner (g) remained on the sieve with the mesh size of 150 μm

B: The amount of toner (g) remained on the sieve with the mesh size of 75 μm

C: The amount of toner (g) remained on the sieve with the mesh size of 45 μm

Flowability is an indicator that indicates a better state when the value thereof is smaller, and is indicated as shown below. If the evaluation criteria C and above are satisfied, it means that the toner is suitable for practical use.

A: 10 or lower

B: from 10 exclusive to 20 inclusive

C: from 20 exclusive to 30 inclusive

D: higher than 30

3) Adhesion to Toner Developing Member Under High-Temperature-High-Humidity Condition Under high-temperature, high-humidity conditions having a temperature of 37° C. and a humidity of 70% RH, with the use of the obtained two-component developer and the evaluators, 10,000 charts each having an image occupation rate of 20% were output, and after this, adhesion to the developing member was evaluated. RICOH FULL COLOR PPC PAPER TYPE 6200 was used as transfer paper. In this system, the degree of adhesion to the developing member could be evaluated equivalently as an amount of toner adhered to the carrier. Hence, it was evaluated as follows.

After images were output, the developer was withdrawn and poured in an appropriate amount into a gauge over which a mesh with a mesh size of 32 μm was tensed, to which air was blown to separate the toner and the carrier from each other. Then, the obtained carrier was put in an amount of 1.0 g into a glass bottle, to which 10 mL of chloroform was added, and which was shaken 50 times and kept stationary for 10 minutes. After this, the supernatant of the chloroform solution was poured into a glass cell, and the transmission of the chloroform solution was measured by a turbidimeter (HAZE COMPUTER manufactured by Suga Test Instruments, Co., Ltd.) The results are shown in Table 2. If the evaluation criteria C and above are satisfied, it means that the toner is suitable for practical use.

A: the transmission is 95% or higher

B: the transmission is 90% or higher but lower than 95%

C: the transmission is 80% or higher but lower than 90%

D: the transmission is lower than 80%

TABLE 1

| | Crystallinity | | | | | Presence/absence of core-shell | Ethyl acetate content | Average | Circularity factor | | Particle size | | |
|---|---|---|---|---|---|---|---|---|---|---|---|---|---|
| | CX | logG'(50) | logG'(65) | tanδ(50) | tanδ(65) | structure | (μg/g) | circularity | SF-1 | SF-2 | Weight-average particle size ($D_4$) | Number-average particle size (Dn) | $D_4$/Dn |
| Example 1 | 42 | 7.2 | 5.4 | 0.2 | 0.7 | Present | 11 | 0.97 | 128 | 120 | 4.4 | 4.2 | 1.05 |
| Example 2 | 49 | 6.5 | 4.5 | 0.4 | 2.0 | Present | 21 | 0.96 | 130 | 124 | 4.2 | 3.9 | 1.09 |
| Example 3 | 42 | 7.4 | 4.6 | 0.1 | 1.9 | Present | 5 | 0.98 | 118 | 112 | 3.6 | 3.3 | 1.09 |

TABLE 1-continued

| | Crystal-linity CX | logG'(50) | logG'(65) | tanδ(50) | tanδ(65) | Presence/ absence of core-shell structure | Ethyl acetate content (μg/g) | Average circularity | Circularity factor SF-1 | Circularity factor SF-2 | Particle size: Weight-average particle size ($D_4$) | Particle size: Number-average particle size (Dn) | $D_4$/Dn |
|---|---|---|---|---|---|---|---|---|---|---|---|---|---|
| Example 4 | 32 | 6.6 | 5.8 | 0.3 | 0.6 | Present | 26 | 0.97 | 129 | 123 | 4.2 | 3.8 | 1.11 |
| Example 5 | 25 | 7.5 | 6.0 | 0.1 | 0.4 | Present | 2 | 0.95 | 140 | 137 | 5.1 | 4.6 | 1.11 |
| Example 6 | 20 | 8.0 | 6.0 | 0.1 | 0.4 | Present | 1 | 0.96 | 138 | 132 | 4.7 | 4.3 | 1.09 |
| Comparative Example 1 | 70 | 6.4 | 4.4 | 0.5 | 2.1 | Present | 32 | 0.97 | 128 | 122 | 4.6 | 4.0 | 1.15 |
| Comparative Example 2 | 71 | 7.7 | 4.3 | 0.03 | 2.3 | Present | 29 | 0.93 | 160 | 151 | 6.7 | 5.6 | 1.20 |
| Comparative Example 3 | 19 | 6.3 | 6.3 | 0.6 | 0.3 | Present | 51 | 0.94 | 152 | 140 | 3.8 | 3.1 | 1.23 |
| Comparative Example 4 | 18 | 7.6 | 6.1 | 0.04 | 0.3 | Present | 28 | 0.94 | 152 | 135 | 5.4 | 4.6 | 1.17 |

TABLE 2

| | Low-temperature fixability under low-temperature, low-humidity condition | Flowability under high-temperature, high-humiditity condition | Adhesion to developing member under high-temperature, high-humidity condition |
|---|---|---|---|
| Example 1 | B | B | B |
| Example 2 | A | C | C |
| Example 3 | B | B | A |
| Example 4 | C | B | C |
| Example 5 | C | B | A |
| Example 6 | C | B | A |
| Example 7 | C | C | B |
| Comparative Example 1 | B | D | D |
| Comparative Example 2 | C | D | B |
| Comparative Example 3 | D | D | D |
| Comparative example 4 | D | C | B |

The aspects of the present invention are as follows, for example.

<1> A toner, including:

a colorant; and a resin, wherein the toner has crystallinity CX of 20 or greater, and has a dynamic viscoelasticity characteristic in which a logarithmic value log G'(50) of storage elastic modulus (Pa) at 50° C. is from 6.5 to 8.0, and a logarithmic value log G'(65) of storage elastic modulus (Pa) at 65° C. is from 4.5 to 6.0, where the dynamic viscoelasticity characteristic is measured by temperature sweep from 40° C., at a frequency of 1 Hz, at a strain amount control of 0.1%, and at a temperature elevating rate of 2° C./min.

<2> the Toner According to <1>, wherein the toner has tan δ(50) of 0.1 to 0.4 at 50° C., and tan δ(65) of 0.4 to 2.0 at 65° C., where tan δ indicates loss tangent (loss coefficient) defined by a ratio G"/G' between storage elastic modulus (G') and loss elastic modulus (G").

<3> The toner according to <1> or <2>, wherein the toner is granulated in a medium containing at least water, an organic solvent, or both thereof.

<4> The toner according to any one of <1> to <3>, wherein the toner contains at least ethyl acetate in an amount of 1 μg/g to 30 μg/g.

<5> The toner according to any one of <1> to <4>, wherein the toner has a core-shell structure.

<6> The toner according to any one of <1> to <5>, wherein the toner contains at least a crystalline polyester resin.

<7> The toner according to any one of <1> to <6>, wherein the toner contains at least a modified polyester resin.

<8> The toner according to any one of <1> to <7>, wherein the toner has an average circularity E of from 0.93 to 0.99.

<9> The toner according to any one of <1> to <8>, wherein the toner has a circularity SF-1 of from 100 to 150, and a circularity SF-2 of from 100 to 140.

<10> The toner according to any one of <1> to <9>, wherein the toner has a weight-average particle size D4 of from 2 μm to 7 μm, and a ratio D4/Dn between the weight-average particle size D4 and a number-average particle size Dn is from 1.00 to 1.25.

<11> An image forming apparatus, including:

a developing unit containing at least a toner and configured to perform development with the toner to form a visible image; and a fixing unit configured to fix the visible image on a recording medium by heat and pressure, wherein the developing unit employs a tandem developing system in which developing sub-units for at least four or more different developing colors are arranged in series, and has a system speed of 200 mm/sec to 3,000 mm/sec, wherein the fixing unit has a fixing medium with a surface pressure of 10 N/cm$^2$ to 3,000 N/cm$^2$, and has a fixing nip time of 30 msec to 400 msec, and wherein the toner is the toner according to any one of <1> to <10>.

<12> An image forming method, including:

performing development with a toner to form a visible image; and fixing the visible image on a recording medium by heat and pressure, wherein in the performing, the development is performed by a tandem developing system in which developing sub-units for at least four or more different developing colors are arranged in series, and a system speed is from 200 mm/sec to 3,000 mm/sec, wherein in the fixing, a surface pressure of a fixing medium is from 10 N/cm$^2$ to 3,000 N/cm$^2$, and a fixing nip time is from 30 msec to 400 msec, and wherein the toner is the toner according to any one of <1> to <10>.

<13> A process cartridge, including:

a latent image carrier; and a developing unit containing at least a toner, wherein the process cartridge supports the latent image carrier and the developing unit integrally and is attachable to and detachable from an image forming apparatus body, and wherein the toner is the toner according to <1> to <10>.

<14> A two-component developer, including:

the toner according to <1> to <10>; and a carrier having a magnetic property.

REFERENCE SIGNS LIST (In FIG. 3 and FIG. 4)
1 photoconductor
2 transfer device
3 sheet conveying belt
4 intermediate transfer member
5 second transfer device
6 sheet feeding device
7 fixing device
8 photoconductor cleaning device
9 intermediate transfer member cleaning device
(In FIG. 5 and FIG. 6)
10 intermediate transfer member
14, 15, 16 support roller
17 intermediate transfer member cleaning device
18 image forming unit
20 tandem image forming device
21 exposure device
22 second transfer device
23 roller
24 second transfer belt
25 fixing device
26 fixing belt
27 pressing roller
28 sheet overturning device
30 document table
32 contact glass
33 first traveling member
34 second traveling member
35 image forming lens
36 reading sensor
40 photoconductor
42, 50 sheet feeding roller
43 paper bank
44 sheet feeding cassette
45, 52 separating roller
46, 48 sheet feeding path
47 conveying roller
49 registration roller
51 manual feeding tray
55 switching claw
56 discharging roller
57 sheet discharging tray
60 charging device
61 developing device
62 first transfer device
63 photoconductor cleaning device
64 neutralizing device
100 copying machine body
200 sheet feeding table
300 scanner
400 automatic document feeder

The invention claimed is:

1. A toner, comprising:

a colorant; and a resin, wherein:

the toner has crystallinity CX of 20 or greater, and has a dynamic viscoelasticity characteristic in which a logarithmic value log G'(50) of storage elastic modulus (Pa) at 50° C. is from 6.5 to 8.0, and a logarithmic value log G'(65) of storage elastic modulus (Pa) at 65° C. is from 4.5 to 6.0, where the dynamic viscoelasticity characteristic is measured by temperature sweep from 40° C., at a frequency of 1 Hz, at a strain amount control of 0.1%, and at a temperature elevating rate of 2° C./min; and the toner has tan δ(50) of 0.1 to 0.4 at 50° C., and tan δ(65) of 0.4 to 2.0 at 65° C., where tan δ indicates loss tangent (loss coefficient) defined by a ratio G"/G' between storage elastic modulus (G') and loss elastic modulus (G").

2. The toner according to claim 1, wherein toner particles of the toner are formed by granulating the resin in a medium comprising water, an organic solvent, or both thereof.

3. The toner according to claim 1, wherein the toner contains at least ethyl acetate in an amount of 1 μg/g to 30 μg/g.

4. The toner according to claim 1, wherein the toner has a core-shell structure.

5. The toner according to claim 1, wherein the toner contains at least a crystalline polyester resin.

6. The toner according to claim 1, wherein the toner contains at least a modified polyester resin.

7. The toner according to claim 1, wherein the toner has an average circularity E of from 0.93 to 0.99.

8. The toner according to claim 1, wherein the toner has a circularity SF-1 of from 100 to 150, and a circularity SF-2 of from 100 to 140.

9. The toner according to claim 1, wherein the toner has a weight-average particle size D4 of from 2 μm to 7 μm, and a ratio D4/Dn between the weight-average particle size D4 and a number-average particle size Dn is from 1.00 to 1.25.

10. An image forming apparatus, comprising:

a developing unit comprising a toner and configured to form a visible image with the toner; and a fixing unit configured to fix the visible image on a recording medium by heat and pressure, wherein:

the developing unit comprises a tandem developing system in which developing sub-units for at least four or more different developing colors are arranged in series, the tandem developing system has a system speed of 200 mm/sec to 3,000 mm/sec, and at least one of the developing sub-units contains the toner;

the fixing unit has a fixing medium with a surface pressure of 10 $N/cm^2$ to 3,000 $N/cm^2$, and has a fixing nip time of 30 msec to 400 msec;

the toner is the toner according to claim 1.

11. An image forming method, comprising:

performing development with a toner to form a visible image; and fixing the visible image on a recording medium by heat and pressure, wherein:

in the performing, the development is performed by a tandem developing system in which developing sub-units for at least four or more different developing colors are arranged in series, a system speed of the tandem developing system is from 200 mm/sec to 3,000 mm/sec, and at least one of the developing sub-units contains the toner;

in the fixing, a surface pressure of a fixing medium is from 10 $N/cm^2$ to 3,000 $N/cm^2$, and a fixing nip time is from 30 msec to 400 msec; and the toner is the toner according to claim 1.

12. A process cartridge, comprising:

a latent image carrier; and a developing unit containing at least a toner, wherein the process cartridge supports the latent image carrier and the developing unit integrally and is attachable to and detachable from an image forming apparatus body, and wherein the toner is the toner according to claim 1.

13. A two-component developer, comprising:

the toner according to claim 1; and a carrier having a magnetic property.

* * * * *